US011631575B2

(12) United States Patent
Yamada et al.

(10) Patent No.: US 11,631,575 B2
(45) Date of Patent: Apr. 18, 2023

(54) INDUCTIVELY COUPLED PLASMA MASS SPECTROMETRY (ICP-MS) WITH IMPROVED SIGNAL-TO-NOISE AND SIGNAL-TO-BACKGROUND RATIOS

(71) Applicant: Agilent Technologies, Inc., Santa Clara, CA (US)

(72) Inventors: Noriyuki Yamada, Tokyo (JP); Erina Shimizu, Hanno (JP)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 17/086,071

(22) Filed: Oct. 30, 2020

(65) Prior Publication Data

US 2021/0050199 A1 Feb. 18, 2021

Related U.S. Application Data

(63) Continuation of application No. 16/351,885, filed on Mar. 13, 2019, now Pat. No. 10,854,438.

(Continued)

(51) Int. Cl.

*H01J 49/00* (2006.01)
*H01J 49/10* (2006.01)

(52) U.S. Cl.

CPC ..... *H01J 49/0072* (2013.01); *H01J 49/005* (2013.01); *H01J 49/0031* (2013.01); *H01J 49/105* (2013.01)

(58) Field of Classification Search

CPC .. H01J 49/00; H01J 49/02; H01J 49/06; H01J 49/26; H01J 49/0045; H01J 49/0072;

(Continued)

(56) References Cited

U.S. PATENT DOCUMENTS 5,847,386 A 12/1998 Thomson et al.
6,111,250 A 8/2000 Thomson et al.

(Continued)

FOREIGN PATENT DOCUMENTS

JP 2013521597 A 6/2013
JP 2013143196 A 7/2013

(Continued)

OTHER PUBLICATIONS

Agilent 7800 Quadrupole ICP-MS. ORS and Helium Mode for More Effective Interference Removal in Complex Samples, Jun. 2015, 2 pages.

(Continued)

*Primary Examiner* — Jason L McCormack

(57) ABSTRACT

In an inductively coupled plasma-mass spectrometry (ICP-MS) system, ions are transmitted into a collision/reaction cell. A DC potential is applied at an exit of the cell at a first magnitude to generate a DC potential barrier effective to prevent the ions from exiting the cell. The DC potential barrier is maintained during a confinement period to perform an interaction. After the confinement period, analyte ions or product ions are transmitted to a mass spectrometer by switching the exit DC potential to a second magnitude effective to allow the analyte ions or product ions to pass through the cell exit as a pulse. The analyte ions or product ions are then counted during a measurement period. The interaction may be ion-molecule reactions or ion-molecule collisions.

18 Claims, 13 Drawing Sheets

Related U.S. Application Data

(60) Provisional application No. 62/644,896, filed on Mar. 19, 2018.

(58) Field of Classification Search
CPC .... H01J 49/0031; H01J 49/005; H01J 49/105; H01J 49/0009; G01N 27/62
USPC ..... 250/281, 282, 288
See application file for complete search history.

(56) References Cited

U.S. PATENT DOCUMENTS

| | | | | |
|---|---|---|---|---|
| 6,265,717 | B1 | 7/2001 | Sakata et al. | |
| 6,875,618 | B2 | 4/2005 | Bandura et al. | |
| 7,671,329 | B2 | 3/2010 | Sakata et al. | |
| 7,872,227 | B2 | 1/2011 | Yamada et al. | |
| 8,610,053 | B2 | 12/2013 | Yamada et al. | |
| 2004/0251411 | A1* | 12/2004 | Bateman | H01J 49/005 250/293 |
| 2008/0067367 | A1* | 3/2008 | Park | H01J 49/004 250/294 |
| 2008/0073500 | A1* | 3/2008 | Cerda | A61P 9/12 250/282 |
| 2008/0251714 | A1* | 10/2008 | Juan | H01J 49/004 250/288 |
| 2009/0236514 | A1* | 9/2009 | Renner | G01N 27/64 250/282 |
| 2011/0284738 | A1 | 11/2011 | Berg et al. | |
| 2012/0100274 | A1* | 4/2012 | Morere | C07D 207/20 426/442 |
| 2012/0119078 | A1* | 5/2012 | Green | H01J 49/4265 250/288 |
| 2012/0248301 | A1* | 10/2012 | Short | H01J 49/147 250/423 P |
| 2015/0364302 | A1* | 12/2015 | Silivra | H01J 49/429 250/424 |
| 2017/0084447 | A1* | 3/2017 | Rottmann | H01J 49/005 |

FOREIGN PATENT DOCUMENTS

| | | | |
|---|---|---|---|
| JP | 2017015676 | A | 1/2017 |
| JP | 2017535040 | A | 11/2017 |
| WO | 2016042632 | A1 | 3/2016 |

OTHER PUBLICATIONS

Agilent 8900 Triple Quadrupole ICP-MS. Leave Interferences Behind with MS/MS, Jun. 2016, 12 pages.

Amr, Mohamed A. "The collision/reaction cell and its application in inductively coupled plasma mass spectrometry for the determination of radioisotopes: A literature review." Advances in Applied Science Research, 2012, 3 (4):2179-2191.

Beaugrand, Claude. Ion Confinement in the Collision Cell of a Multiquadrupole Mass Spectrometer: Access to Chemical Equilibrium and Determination of Kinetic and Thermodynamix Parameters of an Ion-Molecule Reaction. Anal. Chem. 1989, 61, 1447-1453.

Dolnikowski, G.G. et al. Ion-Trapping Technique for Ion/Molecule Reaction Studies in the Center Quadrupole of a Triple Quadrupole Mass Spectrometer. International Journal of Mass Spectrometry and Ion Processes, 82 (1988) 1-15.

Guo, Wei, et al. "Application of ion molecule reaction to eliminate WO interference on mercury determination in soil and sediment samples by ICP-MS." J Anal. at. Spectrom., 2011, 26, 1198-1203.

CAP RQ ICP-MS Pre-Installation Requirements Guide. Revision A. Nov. 2016. ThermoFisher Scientific, 71 pages.

Mccurdy, Ed. "The Benefits of Ms/MS for Reactive Cell Gas Methods in ICP-MS." Agilent ICP-MS Journal. Oct. 2017—vol. 70.

Preparing Your Lab. ICP—Mass Spectrometry. Copyright 2017-2018, 9 pages.

Quarles, C. Derrick, Jr., et al. "Analytical method for total chromium and nickel in urine using an inductively coupled plasma-universal cell technology-mass spectrometer (ICP-USCT-MS) in kinetic energy discrimination (KED) mode." (J. Anal. at. Spectrom., 2014, vol. 29, 297-303.

Tanner, Scott D., et al. "Reaction cells and collision cells for ICP-MS: a tutorial review." Spectrochimica Acta Par B 57 (2002). 1361-1452.

* cited by examiner

Product ion spectra with and without a gas purifier

INDUCTIVELY COUPLED PLASMA MASS SPECTROMETRY (ICP-MS) WITH IMPROVED SIGNAL-TO-NOISE AND SIGNAL-TO-BACKGROUND RATIOS

RELATED APPLICATIONS

This application is a continuation of U.S. patent application Ser. No. 16/351,885 filed Mar. 13, 2019, titled "INDUCTIVELY COUPLED PLASMA MASS SPECTROMETRY (ICP-MS) WITH IMPROVED SIGNAL-TO-NOISE AND SIGNAL-TO-BACKGROUND RATIOS," which application claims the benefit under 35 U.S.C. § 119(e) of U.S. Provisional Patent Application Ser. No. 62/644,896, filed Mar. 19, 2018, titled "INDUCTIVELY COUPLED PLASMA MASS SPECTROMETRY (ICP-MS) WITH IMPROVED SIGNAL-TO-NOISE AND SIGNAL-TO-BACKGROUND RATIOS," the content of both applications of which are incorporated by reference herein in their entirety.

TECHNICAL FIELD

The present invention relates generally to inductively coupled plasma-mass spectrometry (ICP-MS), and particularly to ICP-MS utilizing a collision/reaction cell.

BACKGROUND

Inductively coupled plasma-mass spectrometry (ICP-MS) is often utilized for elemental analysis of a sample, such as to measure the concentration of trace metals in the sample. An ICP-MS system includes a plasma-based ion source to generate plasma to break molecules of the sample down to atoms and then ionize the atoms in preparation for the elemental analysis. In a typical operation, a liquid sample is nebulized, i.e., converted to an aerosol (a fine spray or mist), by a nebulizer (typically of the pneumatic assisted type) and the aerosolized sample is directed into a plasma plume generated by a plasma source. The plasma source often is configured as a flow-through plasma torch having two or more concentric tubes. Typically, a plasma-forming gas such as argon flows through an outer tube of the torch and is energized into a plasma by an appropriate energy source (typically a radio frequency (RF) powered load coil). The aerosolized sample flows through a coaxial central tube (or capillary) of the torch and is emitted into the as-generated plasma. Exposure to plasma breaks the sample molecules down to atoms, or alternatively partially breaks the sample molecules into molecular fragments, and ionizes the atoms or molecular fragments.

The resulting analyte ions, which are typically positively charged, are extracted from the plasma source and directed as an ion beam into a mass analyzer. The mass analyzer applies a time-varying electrical field, or a combination of electrical and magnetic fields, to spectrally resolve ions of differing masses on the basis of their mass-to-charge (m/z) ratios, enabling an ion detector to then count each type of ion of a given m/z ratio arriving at the ion detector from the mass analyzer. Alternatively the mass analyzer may be a time of flight (TOF) analyzer, which measures the times of flight of ions drifting through a flight tube, from which m/z ratios may then be derived. The ICP-MS system then presents the data so acquired as a spectrum of mass (m/z ratio) peaks. The intensity of each peak is indicative of the concentration (abundance) of the corresponding element of the sample.

In addition to analyte ions for which analysis is sought, the plasma produces background (non-analyte) ions. Certain types of non-analyte ions, referred to as interfering ions, can interfere with the analysis of certain types of analytes. The interfering ions may be produced from the plasma-forming gas (e.g., argon), matrix components of the sample, solvents/acids included in the sample, or air (oxygen and nitrogen) entrained into the system. For example, the interfering ions may be isobaric interferents that have the same nominal mass as an analyte ion. The detection of such interfering ions along with the detection of certain analyte ions leads to spectral overlap in the analytical data, thereby reducing the quality of the analysis. Examples of interfering ions include polyatomic ions such as argon oxide, $^{40}Ar^{16}O^{+}$, which interferes with the iron isotope $^{56}Fe^{+}$ because both ions appear at m/z=56 in mass spectra, and argon $^{40}Ar^{+}$, which interferes with the calcium isotope $^{40}Ca^{+}$ because both ions appear at m/z=40.

Known approaches for addressing the problem of spectral interference and improving the performance of an ICP-MS system have involved improvements in matrix separation, the use of cool plasma technology, and the use of mathematical correction equations in the processing of the analytical data. These approaches have known limitations. To further address the problem, it is also known to provide a collision/reaction cell in the ICP-MS system between the ion source and the mass analyzer. The cell includes an ion guide that focuses the ion beam along the central axis of the cell. The cell is filled with either a collision gas or a reactive gas. The use of a collision gas (e.g., helium, He) relies on kinetic energy discrimination (KED) by which polyatomic ion interference can be suppressed. Both the analyte ions and the polyatomic interfering ions in the cell undergo multiple collisions with the collision gas molecules, and lose kinetic energy (KE) and thus are decelerated as a result. However, because the polyatomic ions have larger cross-sections than the analyte ions, the polyatomic interfering ions undergo a greater number of collisions and thus lose more kinetic energy than the analyte ions. A direct-current (DC) potential barrier of positive magnitude is created, such as by biasing the quadrupole electrodes of the mass analyzer outside of the collision/reaction cell to a few volts more positive than the ion guide of the cell. The magnitude of the DC potential barrier is set high enough to prevent the lower-energy interfering ions from entering the mass analyzer, but low enough to allow the higher-energy analyte ions to enter the mass analyzer free of the interfering ions. In this manner, the contribution of interfering ions to the mass spectral data is suppressed.

Alternatively, the cell is filled with a reactive gas. Depending on the chemical properties of the reactive gas, the reactive gas chosen for use reacts with either the interfering ion or the analyte ion. In the case of reaction with the interfering ion, the reaction either converts the interfering ion to a non-interfering ion (by changing the mass of the interfering ion to a mass that does not interfere with the mass of the analyte ion) or neutralizes the interfering ion. In the case of reaction with the analyte ion, the reaction in effect shifts the mass of the analyte ion to a higher mass by forming a product ion with which the original interfering ion does not interfere. In all such cases, the cell is filled with a reactive gas at a certain pressure to obtain sufficient efficiency of reaction with the interfering ion or the analyte ion. However, the optimum pressure (or gas density) often varies from one element to another element. Therefore, the flow rate of the reaction gas has to be changed when different elements are measured, in order to obtain a good signal-to-background (S/B) ratio for each element.

Therefore, there continues to be a need for an improved ICP-MS system and method for operating it to address the problem of interferences.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, a method for operating a collision/reaction cell to suppress interferences in an inductively coupled plasma-mass spectrometry (ICP-MS) system includes: flowing a collision/reaction gas into the collision/reaction cell, the collision/reaction cell comprising an entrance, an exit, and a multipole ion guide positioned between the entrance and the exit; transmitting ions through the entrance and into the collision/reaction cell; applying an exit DC potential at the exit at a first magnitude to generate a DC potential barrier effective to prevent the ions from exiting the collision/reaction cell; maintaining the exit DC potential at the first magnitude during a confinement period; after the confinement period, transmitting analyte ions or product ions produced from the analyte ions to a mass spectrometer by switching the exit DC potential to a second magnitude effective to allow the analyte ions or product ions to pass through the exit as a pulse having a pulse duration; and measuring the analyte ions or product ions for a measurement period having a duration approximately equal to the pulse duration.

In an embodiment, the method includes performing an interaction between the collision/reaction gas and the ions during the confinement period. The interaction may be one that is effective to suppress interfering ion signal intensity as may be measured by the mass spectrometer. The interaction may be an ion-molecule reaction and/or an ion-molecule collision. Thus, in one embodiment, the interaction involves reacting interfering ions with the collision/reaction gas according to a reaction effective to convert the interfering ions to non-interfering ions or to neutral species, and colliding analyte ions with the collision/reaction gas a plurality of times effective to slow down and confine the analyte ions in the collision/reaction cell. In another embodiment, the interaction involves reacting analyte ions with the collision/reaction gas according to a reaction effective to produce product ions, and colliding the product ions with the collision/reaction gas a plurality of times effective to slow down and confine the product ions in the collision/reaction cell.

According to another embodiment, a method for operating a collision/reaction cell in an inductively coupled plasma-mass spectrometry (ICP-MS) system includes: flowing a collision/reaction gas into a collision/reaction cell configured according to any of the embodiments disclosed herein; transmitting ions through the entrance and into the collision/reaction cell; applying an exit DC potential at the exit at a first magnitude to generate a DC potential barrier effective to prevent the ions from exiting the collision/reaction cell; maintaining the exit DC potential at the first magnitude during a confinement period; during the confinement period, colliding the ions with the collision/reaction gas, wherein the ions undergo collisions a plurality of times effective to slow down and confine the ions in the collision/reaction cell; after the confinement period, transmitting at least the analyte ions of the confined ions, or product ions produced from the analyte ion, to a mass spectrometer, by switching the exit DC potential to a second magnitude effective to allow the analyte ions or product ions to pass through the exit as a pulse having a pulse duration; and measuring the analyte ions or product ions for a measurement period having a duration approximately equal to the pulse duration.

According to another embodiment, a method for analyzing a sample includes: producing analyte ions from the sample; transmitting the analyte ions into a collision/reaction cell configured according to any of the embodiments disclosed herein; operating the collision/reaction cell according to the any of the methods disclosed herein; and transmitting the analyte ions into a mass analyzer of the mass spectrometer.

According to another embodiment, an inductively coupled plasma-mass spectrometry (ICP-MS) system includes: an ion source configured to generate plasma and produce analyte ions in the plasma; a collision/reaction cell comprising an entrance configured to receive the analyte ions from the ion source, an exit spaced from the entrance along a longitudinal axis of the collision/reaction cell, and a multipole ion guide positioned between the entrance and the exit and configured to confine ions in a radial direction orthogonal to the longitudinal axis; a mass spectrometer communicating with the exit; and a controller comprising an electronic processor and a memory, and configured to control an operation comprising: flowing a collision/reaction gas into the collision/reaction cell; transmitting ions through the entrance and into the collision/reaction cell; applying an exit DC potential at the exit at a first magnitude to generate a DC potential barrier effective to prevent the ions from exiting the collision/reaction cell; maintaining the exit DC potential at the first magnitude during a confinement period; after the confinement period, transmitting analyte ions or product ions produced from the analyte ions to the mass spectrometer by switching the exit DC potential to a second magnitude effective to allow the analyte ions or product ions to pass through the exit as a pulse having a pulse duration; and measuring the analyte ions or product ions for a measurement period having a duration approximately equal to the pulse duration.

In an embodiment, the controller of the ICP-MS system is configured to control an interaction during the confinement period. In one embodiment, the interaction involves reacting interfering ions with the collision/reaction gas according to a reaction effective to convert the interfering ions to non-interfering ions or to neutral species, and colliding analyte ions with the collision/reaction gas a plurality of times effective to slow down and confine the analyte ions in the collision/reaction cell. In another embodiment, the interaction involves reacting analyte ions with the collision/reaction gas according to a reaction effective to produce product ions, and colliding the product ions with the collision/reaction gas a plurality of times effective to slow down and confine the product ions in the collision/reaction cell.

According to another embodiment, an inductively coupled plasma-mass spectrometry (ICP-MS) system includes: an ion source configured to generate plasma and produce analyte ions in the plasma; a collision/reaction cell according to any of the embodiments disclosed herein; and a controller comprising an electronic processor and a memory, and configured to control the steps of any of the methods disclosed herein.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
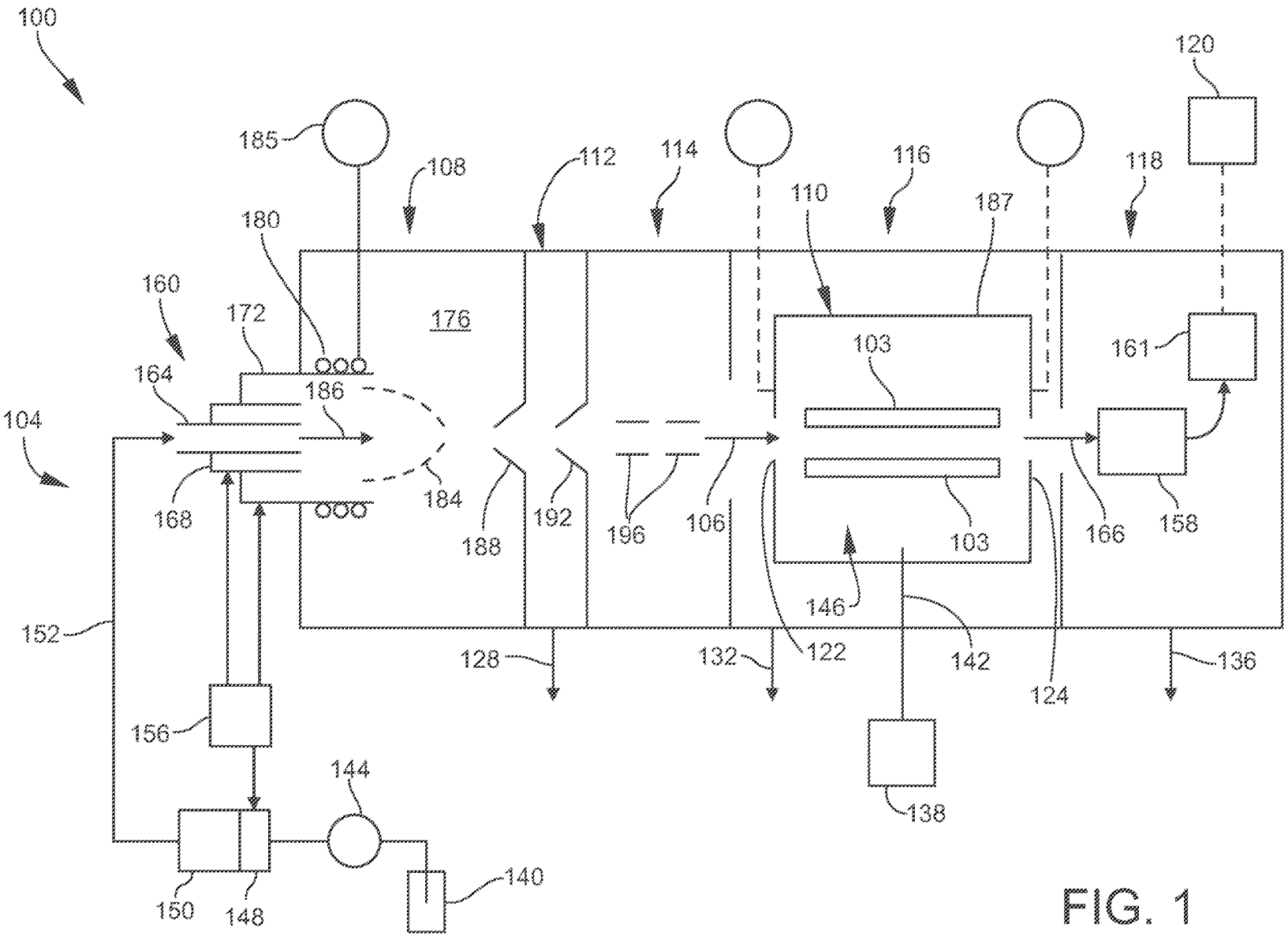
FIG. 1 is a schematic view of an example of an inductively coupled plasma-mass spectrometry (ICP-MS) system according to an embodiment of the present disclosure.

As used herein, the term "fluid" is used in a general sense to refer to any material that is flowable through a conduit. Thus, the term "fluid" may generally refer to either a liquid or a gas, unless specified otherwise or the context dictates otherwise.

As used herein, the term "liquid" may generally refer to a solution, a suspension, or an emulsion. Solid particles and/or gas bubbles may be present in the liquid.

As used herein, the term "aerosol" generally refers to an assembly of liquid droplets and/or solid particles suspended in a gaseous medium. The size of aerosol droplets or particles is typically on the order of micrometers (μm). See Kulkarni et al., Aerosol Measurement, 3rd ed., John Wiley & Sons, Inc. (2011), p. 821. An aerosol may thus be considered as comprising liquid droplets and/or solid particles and a gas that entrains or carries the liquid droplets and/or solid particles.

As used herein, the term "atomization" refers to the process of breaking molecules down to atoms. Atomization may be carried out, for example, in a plasma enhanced environment. In the case of a liquid sample, "atomizing" may entail nebulizing the liquid sample to form an aerosol, followed by exposing the aerosol to plasma or to heat from the plasma.

As used herein, a "liquid sample" includes one or more different types of analytes of interest dissolved or otherwise carried in a liquid matrix. The liquid matrix includes matrix components. Examples of "matrix components" include, but are not limited to, water and/or other solvents, acids, soluble materials such as salts and/or dissolved solids, undissolved solids or particulates, and any other compounds that are not of analytical interest.

For convenience in the present disclosure, unless specified otherwise or the context dictates otherwise, a "collision/reaction cell" refers to a collision cell, a reaction cell, or a collision/reaction cell configured to operate as both a collision cell and a reaction cell, such as by being switchable between a collision mode and a reaction mode.

For convenience in the present disclosure, unless specified otherwise or the context dictates otherwise, a "collision/reaction gas" refers to an inert collision gas utilized to collide with ions in a collision/reaction cell without reacting with such ions, or a reactive gas utilized to react with analyte ions or interfering ions in a collision/reaction cell.

As used herein, the term "analyte ion" generally refers to any ion produced by ionizing a component of a sample being analyzed by an inductively coupled plasma-mass spectrometry (ICP-MS) system, for which mass spectral data is sought. In the specific context of ICP-MS, analyte ions are typically positive monatomic ions of a metal or other element except for a rare (noble) gas (e.g., argon), or are product ions produced by reacting a collision/reaction gas with positive monatomic ions of a metal or other element except for a rare gas.

As used herein, the term "interfering ion" generally refers to any ion present in a mass spectrometry system that interferes with an analyte ion. Examples of interfering ions include, but are not limited to, positive plasma (e.g., argon) ions, polyatomic ions containing plasma-forming gases (e.g., argon), and doubly-charged, isobaric and polyatomic ions containing a component of the sample. The component of the sample may be an analyte element or a non-analyte species such as may be derived from the matrix components of the sample or other background species.

FIG. 1 is a schematic view of an example of an inductively coupled plasma-mass spectrometry (ICP-MS) system 100 according to an embodiment. Generally, the structures and operations of various components of ICP-MS systems are known to persons skilled in the art, and accordingly are described only briefly herein as necessary for understanding the subject matter being disclosed.

In the present illustrative embodiment, the ICP-MS system 100 generally includes a sample introduction section 104, an ion source 108, an interface section 112, an ion optics section 114, an ion guide section 116, a mass analysis section 118, and a system controller 120. The ICP-MS system 100 also includes a vacuum system configured to exhaust various internal regions of the system 100. The vacuum system maintains desired internal pressures or vacuum levels in the internal regions, and in doing so removes neutral molecules not of analytical interest from the ICP-MS system 100. The vacuum system includes appropriate pumps and passages communicating with ports of the regions to be evacuated, as depicted by arrows 128, 132, and 136 in FIG. 1.

The sample introduction section 104 may include a sample source 140 for providing the sample to be analyzed, a pump 144, a nebulizer 148 for converting the sample into an aerosol, a spray chamber 150 for removing larger droplets from the aerosolized sample, and a sample supply conduit 152 for supplying the sample to the ion source 108, which may include a suitable sample injector. The nebulizer 148 may, for example, utilize a flow of argon or other inert gas (nebulizing gas) from a gas source 156 (e.g., a pressurized reservoir) to aerosolize the sample, as depicted by a downward arrow. The nebulizing gas may be the same gas as the plasma-forming gas utilized to create plasma in the ion source 108, or may be a different gas. The pump 144 (e.g., peristaltic pump, syringe pump, etc.) is connected between the sample source 140 and the nebulizer 148 to establish a flow of liquid sample to the nebulizer 148. The sample flow rate may be in the range between, for example, 0.1 and a few milliliters per minute (mL/min). The sample source 140 may, for example, include one or more vials. A plurality of vials may contain one or more samples, various standard solutions, a tuning liquid, a calibration liquid, a rinse liquid, etc. The sample source 140 may include an automated device configured to switch between different vials, thereby enabling the selection of a particular vial for present use in the ICP-MS system 100.

In another embodiment, the sample may be a gas and not require a nebulizer 148. In another embodiment, the sample source 140 may be or include a pressurized reservoir containing a liquid or gas sample and not require the pump 144. In another embodiment, the sample source 140 may be the output of an analytical separation instrument such as, for example, a liquid chromatography (LC) or gas chromatography (GC) instrument. Other types of devices and means for sample introduction into ICP-MS systems are known and need not be described herein.

The ion source 108 includes a plasma source for atomizing and ionizing the sample. In the illustrated embodiment, the plasma source is flow-through plasma torch such as an ICP torch 160. The ICP torch 160 includes a central or sample injector 164 and one or more outer tubes concentrically arranged about the sample injector 164. In the illustrated embodiment, the ICP torch 160 includes an intermediate tube 168 and an outermost tube 172. The sample injector 164, intermediate tube 168, and outermost tube 172 may be constructed from, for example, quartz, borosilicate glass, or a ceramic. The sample injector 164 alternatively may be constructed from a metal such as, for example, platinum. The ICP torch 160 is located in an ionization chamber (or "torch box") 176. A work coil 180 (also termed a load coil or RF coil) is coupled to a radio frequency (RF) power source 185 and is positioned at the discharge end of the ICP torch 160.

In operation, the gas source 156 supplies a plasma-forming gas to the outermost tube 172. The plasma-forming gas is typically, but not necessarily, argon. RF power is applied to the work coil 180 by the RF power source 185 while the plasma-forming gas flows through the annular channel formed between the intermediate tube 168 and the outermost tube 172, thereby generating a high-frequency, high-energy electromagnetic field to which the plasma-forming gas is exposed. The work coil 180 is operated at a frequency and power effective for generating and maintaining plasma from the plasma-forming gas. A spark may be utilized to provide seed electrons for initially striking the plasma. Consequently, a plasma plume 184 flows from the discharge end of the ICP torch 160 into a sampling cone 188. An auxiliary gas may be flowed through the annular channel formed between the sample injector 164 and the intermediate tube 168 to keep the upstream end of the discharge 184 away from the ends of the sample injector 164 and the intermediate tube 168. The auxiliary gas may be the same gas as the plasma-forming gas or a different gas. The conduction of gas(es) into the intermediate tube 168 and the outermost tube 172 is depicted in FIG. 1 by arrows directed upward from the gas source 156. The sample flows through the sample injector 164 and is emitted from the sample injector 164 and injected into the active plasma 184, as depicted by an arrow 186. As the sample flows through the heating zones of the ICP torch 160 and eventually interacts with the plasma 184, the sample undergoes drying, vaporization, atomization, and ionization, whereby analyte ions are produced from components (particularly atoms) of the sample, according to principles appreciated by persons skilled in the art.

The interface section 112 provides the first stage of pressure reduction between the ion source 108, which typically operates at or around atmospheric pressure (760 Torr), and the evacuated regions of the ICP-MS system 100. For example, the interface section 112 may be maintained at an operating vacuum of for example around 1-2 Torr by a mechanical roughing pump (e.g., a rotary pump, scroll pump, etc.), while the mass analyzer 120 may be maintained at an operating pressure of for example around $10^{-6}$ Torr by a high-vacuum pump (e.g., a turbomolecular pump, etc.). The interface section 112 includes a sampling cone 188 positioned across the ionization chamber 176 from the discharge end of the ICP torch 160, and a skimmer cone 192 positioned at a small axial distance from the sampling cone 188. The sampling cone 188 and the skimmer cone 192 have small orifices at the center of their conical structures that are aligned with each other and with the central axis of the ICP torch 160. The sampling cone 188 and the skimmer cone 192 assist in extracting the plasma 184 from the torch into the vacuum chamber, and also serve as gas conductance barriers to limit the amount of gas that enters the interface section 112 from the ion source 108. The sampling cone 188 and the skimmer cone 192 may be metal (or at least the tips defining their apertures may be metal) and may be electrically grounded. Neutral gas molecules and particulates entering the interface section 112 may be exhausted from the ICP-MS system 100 via the vacuum port 128.

The ion optics section 114 and the subsequent ion guide section 116 may be provided in the second stage of pressure reduction between the skimmer cone 192 and the mass analysis section 118. The ion optics section 114 includes a lens assembly 196, which may include a series of (typically electrostatic) ion lenses that assist in extracting the ions from the interface section 112, focusing the ions as an ion beam 106, and accelerating the ions into the ion guide section 116. The ion optics section 114 may be maintained at an operating pressure of for example around $10^{-3}$ Torr by a suitable pump (e.g., a turbomolecular pump). While not specifically shown in FIG. 1, the lens assembly 196 may be configured such that the ion optical axis through the lens assembly 196 is offset (in the radial direction orthogonal to the longitudinal axis) from the ion optical axis through the ion guide section 116, with the ion beam 106 steered through the offset. Such configuration facilitates the removal of neutral species and photons from the ion path.

The ion guide section 116 includes a collision/reaction cell (or cell assembly) 110. The collision/reaction cell 110 includes an ion guide 146 positioned in a cell housing 187 axially between a cell entrance and a cell exit. In the present embodiment, the cell entrance and cell exit are provided by ion optics components. Namely, a cell entrance lens 122 is positioned at the cell entrance, and a cell exit lens 124 is positioned at the cell exit. The ion guide 146 has a linear multipole (e.g., quadrupole, hexapole, or octopole) configuration that includes a plurality of (e.g., four, six, or eight) rod electrodes 103 arranged in parallel with each other along a common central longitudinal axis of the ion guide 146. The rod electrodes 103 are each positioned at a radial distance from the longitudinal axis, and are circumferentially spaced from each other about the longitudinal axis. For simplicity, only two such rod electrodes 103 are illustrated in FIG. 1. An RF power source (described further below) applies RF potentials to the rod electrodes 103 of the ion guide 146 in a known manner that generates a two-dimensional RF electric field between the rod electrodes 103. The RF field serves to focus the ion beam 106 along the longitudinal axis by limiting the excursions of the ions in radial directions relative to the longitudinal axis. In a typical embodiment, the ion guide 146 is an RF-only device without the capability of mass filtering. In another embodiment, the ion guide 146 may function as a mass filter, by superposing DC potentials on the RF potentials as appreciated by persons skilled in the art.

A collision/reaction gas source 138 (e.g., a pressurized reservoir) is configured to flow one or more (e.g., a mixture of) collision/reaction gases into the interior of the collision/reaction cell 110 via a collision/reaction gas feed conduit and port 142 leading into the interior of the cell housing 187. The gas flow rate is on the order of milliliters per minute (mL/min) or milligrams per minute (mg/min). The gas flow rate determines the pressure inside the collision/reaction cell 110. The cell operating pressure may be, for example, in a range from 0.001 Torr to 0.1 Torr. Examples of collision/reaction gases include, but are not limited to, helium, neon, argon, hydrogen, oxygen, water, ammonia, methane, fluoromethane ($CH_3F$), and nitrous oxide ($N_2O$), as well as combinations (mixtures) or two or more of the foregoing. Inert (nonreactive) gases such as helium, neon, and argon are utilized as collision gases. The operation of the collision/reaction cell 110 according to the present disclosure is described in more detail below.

The mass analysis section 118 (also referred to herein as the mass spectrometer) includes a mass analyzer 158 and an ion detector 161, comprising the third (final) stage of pressure reduction. The mass analyzer 158 may be any type suitable for ICP-MS. Examples of mass analyzers include, but are not limited to, multipole electrode structures (e.g., quadrupole mass filters, linear ion traps, three-dimensional Paul traps, etc.), time-of-flight (TOF) analyzers, magnetic and/or electric sector instruments, electrostatic traps (e.g. Kingdon, Knight and ORBITRAP® traps) and ion cyclotron resonance (ICR) traps (FT-ICR or FTMS, also known as Penning traps). According to an aspect of the presently disclosed subject matter, the collision/reaction cell 110 is configured to emit ions as an ion pulse or packet (as described further below), but may be utilized in conjunction with a continuous-beam (e.g., non-pulsed, non-trapping, or non-storing) mass-analyzing instrument that receives the ion pulse(s) from the collision/reaction cell 110, such as a quadrupole mass filter or other multipole device configured for non-pulsed operation, a sector instrument (e.g., containing magnetic and/or electric sectors, including double-focusing instruments), etc. The ion detector 161 may be any device configured for collecting and measuring the flux (or current) of mass-discriminated ions outputted from the mass analyzer 158. Examples of ion detectors include, but are not limited to, electron multipliers, photomultipliers, microchannel plate (MCP) detectors, image current detectors, and Faraday cups. For convenience of illustration in FIG. 1, the ion detector 161 (at least the front portion that receives the ions) is shown to be oriented at a ninety degree angle to the ion exit of the mass analyzer 158. In other embodiments, however, the ion detector 161 may be on-axis with the ion exit of the mass analyzer 158.

In operation, the mass analyzer 158 receives an ion beam 166 from the collision/reaction cell 110 and separates or sorts the ions on the basis of their differing mass-to-charge (m/z) ratios. The separated ions pass through the mass analyzer 158 and arrive at the ion detector 161. The ion detector 161 measures (i.e., detects and counts) each ion and outputs an electronic detector signal (ion measurement signal) to the data acquisition component of the system controller 120. The mass discrimination carried out by the mass analyzer 158 enables the ion detector 161 to detect and count ions having a specific m/z ratio separately from ions having other m/z ratios (derived from different analyte elements of the sample), and thereby produce ion measurement signals for each ion mass (and hence each analyte element) being analyzed. Ions with different m/z ratios may be detected and counted in sequence. The system controller 120 processes the signals received from the ion detector 161 and generates a mass spectrum, which shows the relative signal intensities (abundances) of each ion detected. The signal intensity so measured at a given m/z ratio (and therefore a given analyte element) is directly proportional to the concentration of that element in the sample processed by the ICP-MS system 100. In this manner, the existence of chemical elements contained in the sample being analyzed can be confirmed and the concentrations of the chemical elements can be determined.

While not specifically shown in FIG. 1, the ion optical axis through the ion guide 146 and cell exit lens 124 may be offset from the ion optical axis through the entrance into the mass analyzer 158, and ion optics may be provided to steer the ion beam 166 through the offset. By this configuration, additional neutral species are removed from the ion path.

The system controller (or controller, or computing device) 120 may include one or more modules configured for controlling, monitoring and/or timing various functional aspects of the ICP-MS system 100 such as, for example, controlling the operations of the sample introduction section 104, the ion source 108, the ion optics section 114, the ion guide section 116, and the mass analysis section 118, as well as controlling the vacuum system and various gas flow rates, temperature and pressure conditions, and other sample processing components provided in the ICP-MS system 100 that require control. The system controller 120 is representative of the electrical circuitry (e.g., RF and DC voltage sources) utilized to operate the collision/reaction cell 110. The system controller 120 may also be configured for receiving the detection signals from the ion detector 161 and performing other tasks relating to data acquisition and signal analysis as necessary to generate data (e.g., a mass spectrum) characterizing the sample under analysis. The system controller 120 may include a non-transitory computer-readable medium that includes non-transitory instructions for performing any of the methods disclosed herein. The system controller 120 may include one or more types of hardware, firmware and/or software, as well as one or more memories and databases, as needed for operating the various components of the ICP-MS system 100. The system controller 120 typically includes a main electronic processor providing overall control, and may include one or more electronic processors configured for dedicated control operations or specific signal processing tasks. The system controller 120 may also include one or more types of user interface devices, such as user input devices (e.g., keypad, touch screen, mouse, and the like), user output devices (e.g., display screen, printer, visual indicators or alerts, audible indicators or alerts, and the like), a graphical user interface (GUI) controlled by software, and devices for loading media readable by the electronic processor (e.g., non-transitory logic instructions embodied in software, data, and the like). The system controller 120 may include an operating system (e.g., Microsoft Windows® software) for controlling and managing various functions of the system controller 120.

It will be understood that FIG. 1 is a high-level schematic depiction of the ICP-MS system 100 disclosed herein. As appreciated by persons skilled in the art, other components such as additional structures, devices, and electronics may be included as needed for practical implementations, depending on how the ICP-MS system 100 is configured for a given application.

For example, in an embodiment, the ICP-MS system 100 is configured as a triple quadrupole ICP-MS system, and may be referred to as an ICP-MS/MS (tandem MS) or ICP-QQQ system. In such embodiment, an additional vacuum chamber (not shown) is provided between the ion optics section 114 and the ion guide section 116, and a first (or pre-cell) quadrupole mass filter Q1 (not shown) is positioned in the additional vacuum chamber. The mass analyzer 158 in this case corresponds to the second (final) quadrupole mass filter Q2. Quadrupole mass filters are described briefly herein, and are generally known to persons skilled in the art. The ion guide 146 of the collision/reaction cell 110 corresponds to the central "Q" in the QQQ configuration, but may be an octopole or hexapole instead of a quadrupole as noted elsewhere herein. As with the mass analysis section 118 containing the mass analyzer 158, the additional vacuum chamber containing the first, pre-cell mass filter Q1 is operated at a very low pressure (high vacuum) to enable the first mass filter to operate (if desired) at unit-mass resolution (1 Da mass window). The gas-filled collision/reaction cell 110 is thus operated at a higher pressure than both the vacuum chamber containing the first, pre-cell mass filter Q1 and the mass analysis section 118 containing the second, final quadrupole mass filter Q2 (mass analyzer 158). The vacuum system of the ICP-MS system 100 is configured to maintain the different pressure conditions in the three vacuum stages by utilizing appropriately selected and configured pumps, gas passages, etc.

In operation, the first, pre-cell mass filter Q1 is set to pass only the target analyte ion mass to the collision/reaction cell 110, while rejecting all other ion masses. Consequently, only the target analyte ions and on-mass polyatomic interfering ions (if any) enter the collision/reaction cell 110. This additional, pre-cell mass-selection step may provide greater predictability, consistency, and control over the ion-molecule reaction chemistry occurring in the collision/reaction cell 110. For example, by rejecting non-target analyte ions and matrix component ions, the first, pre-cell mass filter Q1 may prevent the formation of unwanted (and potentially interfering) product ions in the collision/reaction cell 110. The collision/reaction cell 110 then removes the interferences as described herein. In the case where the interfering ions react with the gas in the collision/reaction cell 110, the second, final quadrupole mass filter Q2 (mass analyzer 158) is set to pass only the target analyte ions to the ion detector 161. Alternatively, in the case where the target analyte ions react with the gas, the mass analyzer 158 is set to pass only the target product ions (derived from the original analyte ion by such reaction) to the ion detector 161.

In another embodiment, a pre-cell mass filter is provided but is operated as a bandpass filter having a bandpass window spanning a selected range of ion masses, for example a window width of 10 Da. The partial mass rejection provided by such embodiment may be useful in some applications. In such embodiment, the pre-cell mass filter may be positioned either in an additional vacuum chamber (not shown) preceding the ion guide section 116 as just described above, or directly in the ion guide section 116 together with the collision/reaction cell 110.

In applications for which pre-cell mass selection is not required or desired, the pre-cell mass filters just described (if provided in the ICP-MS system) may be operated as RF-only ion guides that assist in directing ion beams into the collision/reaction cell 110. Examples of the use of a pre-cell mass filter in an ICP-MS system are described in U.S. Pat. No. 8,610,053 to Yamada et al.; and McCurdy, Ed, "The Benefits of MS/MS for Reactive Cell Gas Methods in ICP-MS," Agilent ICP-MS Journal, p. 2-3, Issue 70, October 2017; the contents of each of which are incorporated herein by reference in their entireties.

Figure 2:
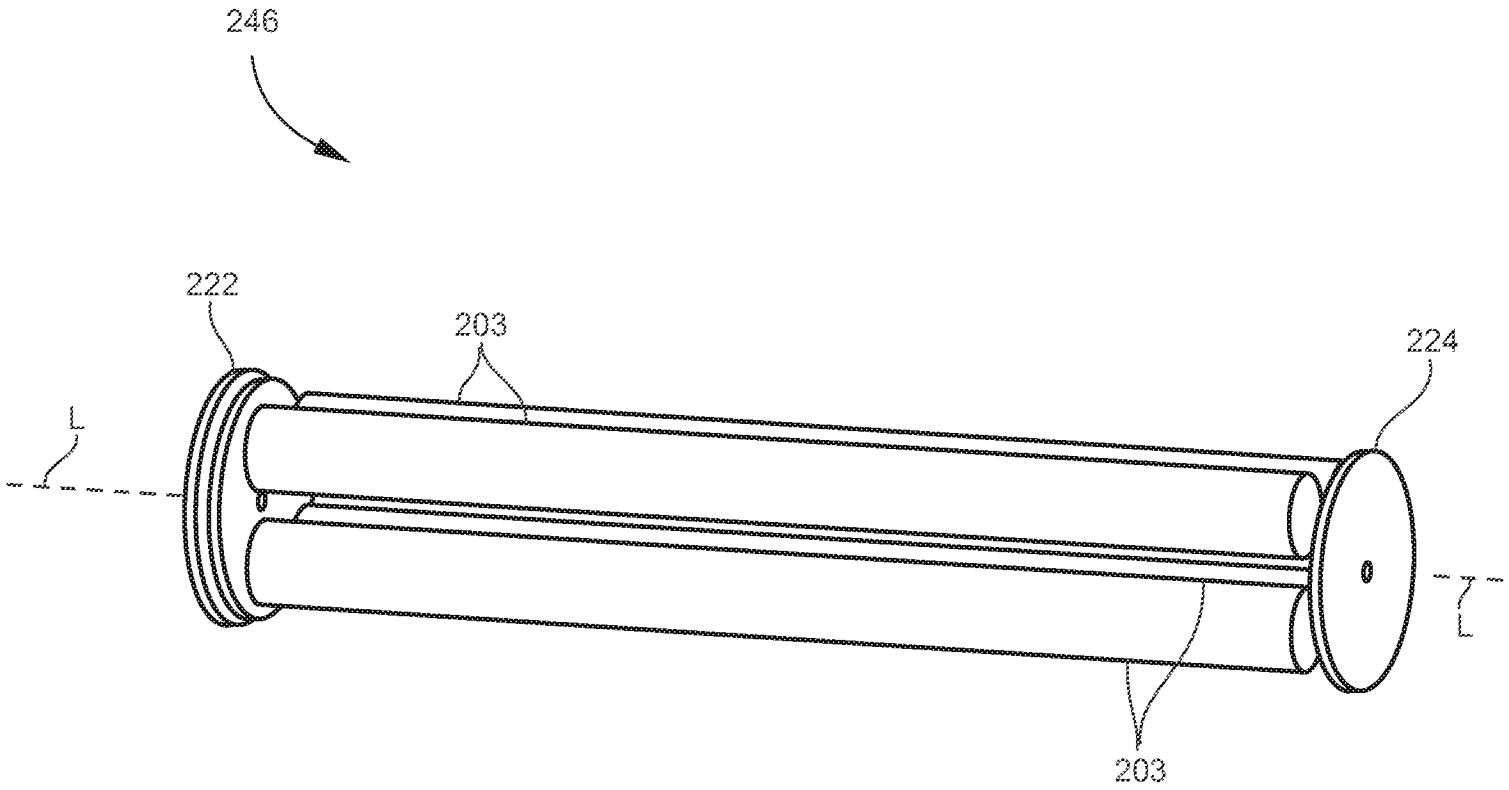
FIG. 2 is a schematic perspective view of an example of an ion guide for a collision/reaction cell according to an embodiment of the present disclosure.
Figure 3:
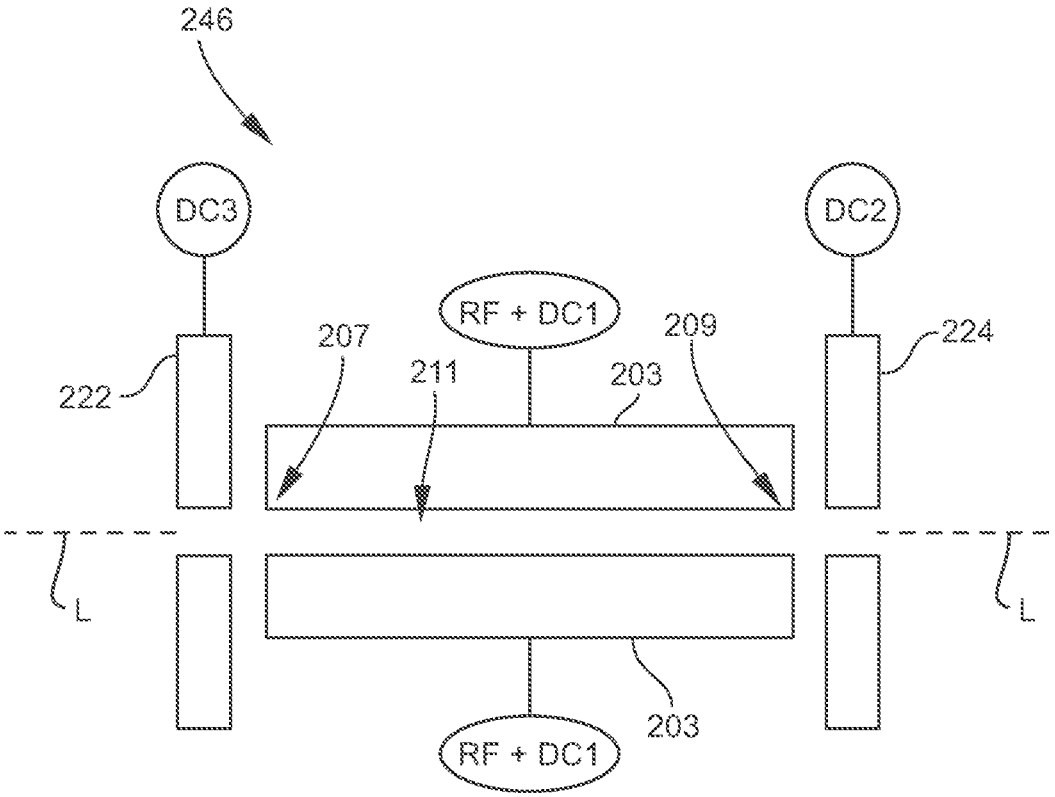
FIG. 3 is a schematic side (lengthwise) view of the ion guide illustrated in FIG. 2.

FIG. 2 is a schematic perspective view of an example of an ion guide 246 according to an embodiment. FIG. 3 is a schematic side (lengthwise) view of the ion guide 246. The ion guide 246 is configured for operation in a collision/reaction cell assembly such as the collision/reaction cell assembly 110 described herein and illustrated in FIG. 1. The ion guide 246 is positioned between the cell entrance and the cell exit. A cell entrance lens 222 may be positioned at the cell entrance, and a cell exit lens 224 may be positioned at the cell exit.

The ion guide 246 includes a plurality of ion guide electrodes 203 (or "rod electrodes"). The ion guide electrodes 203 are circumferentially spaced from each other about a longitudinal axis L of the ion guide 246. Each ion guide electrode 203 is positioned at a radial distance from (and orthogonal to) the longitudinal axis L and is elongated along the longitudinal axis L. Accordingly, the ion guide electrodes 203 define an ion guide entrance 207 near the cell entrance lens 222, an ion guide exit 209 axially spaced from the ion guide entrance 207 by an axial length of the ion guide electrodes 203 and near the cell exit lens 224, and an axially elongated ion guide interior 211 extending from the ion guide entrance 207 to the ion guide exit 209.

FIG. 2 illustrates one embodiment in which the ion guide 246 has a quadrupole configuration (four ion guide electrodes). In other embodiments, the ion guide 246 may have a higher-order multipole configuration, for example a hexapole (six ion guide electrodes), octopole (eight ion guide electrodes), or even higher-order multipole configuration. As shown in FIG. 2, the ion guide electrodes 203 may be cylindrical with circular cross-sections. Alternatively, in the quadrupole case the surface of the ion guide electrodes 203 facing the ion guide interior 211 may have a hyperbolic profile. As another alternative the ion guide electrodes 203 may have polygonal (prismatic, e.g. square, rectangular, etc.) cross-sections.

FIG. 3 further schematically illustrates electronics (electrical circuitry) that may be utilized to apply RF and DC potentials to various components. The system controller 120 described above and illustrated in FIG. 1 may be considered as being representative of such electronics. In FIG. 3, the electronics include an RF source, RF, superimposed on a first DC source DC1 communicating with the ion guide electrodes 203, as schematically depicted as a voltage source RF+DC1. The electronics further include a second DC source DC2 communicating with the cell exit lens 224, and may further include a third DC source DC3 communicating with the cell entrance lens 222. The various RF and DC sources may also be referred to collectively as a "voltage source" or "voltage sources."

In operation, the RF+DC1 source applies RF potentials RF superimposed on DC bias potentials DC1 (i.e., RF+DC1) to the ion guide electrodes 203 at a frequency and amplitude effective to generate a two-dimensional, time-varying RF field in the ion guide 246. Typically, each opposing pair of ion guide electrodes 203 is electrically interconnected. The RF potential applied to one opposing pair of ion guide electrodes 203 is 180 degrees out of phase with the RF potential applied to an adjacent opposing pair of ion guide electrodes 203 (−RF+DC1, not shown in FIG. 3), as appreciated by persons skilled in the art. The RF field radially confines the ions in the ion guide 246, i.e., limits the motions of the ions in the radial direction, thereby focusing the ions as an ion beam concentrated on the longitudinal axis L. In this manner, the ion guide 246 is operated as an RF-only ion guide in which the RF fields function only to focus the ions along the longitudinal axis L.

In another embodiment, however, in which the ion guide 246 has a quadrupole electrode structure, DC fields with opposite polarities, ±U, may be superposed on the RF field to enable the ion guide 246 to function as a mass filter. Namely, +RF+U+DC1 may be applied to one pair of ion guide electrodes 203; −RF−U+DC1 may be applied to the other pair of ion guide electrodes 203. According to known principles, by appropriately selecting the operating parameters of the composite RF/DC field (RF amplitude, RF frequency, and DC magnitude), the ion guide 246 can be configured to impose a mass range (bandpass) that allows only a single ion mass, or a narrow range of ion masses (from a low-mass cut-off point to a high-mass cut-off point), to pass through the ion guide 246. Ions having masses within the mass bandpass have stable trajectories and are able to traverse the entire length of the ion guide 246. Ions having masses outside the mass bandpass have unstable trajectories and thus will be rejected. That is, such ions will overcome the RF confining field and be removed from the ion guide 246 without the possibility of exiting the ion guide 246. The mass bandpass can be adjusted by adjusting one or more of the operating parameters of the composite RF/DC field, enabling the selection of a specific ion mass or masses to be transmitted out from the ion guide 246 at any given time. In some embodiments, this "scanning" function may be implemented to facilitate the process of suppressing the contribution of interfering ions to the mass spectral data, as described elsewhere herein.

In one embodiment, the first DC source DC1 applies a negative DC bias potential to the ion guide electrodes 203 that is constant along their length.

In another embodiment, the first DC source DC1 may be configured to generate an axial DC potential gradient along the length of the ion guide electrodes 203. For this purpose, the first DC source supplies two different DC potentials, DC1*a* and DC1*b*, which may be coupled to the entrance and exit ends of the ion guide electrodes 203, respectively. For example, the DC potentials DC1*a* and DC1*b* may be coupled to the entrance and exit ends of ion guide electrodes 203, respectively, that are made of electrically conductive or resistive material. As described, for example, in U.S. Pat. No. 6,111,250, the content of which are incorporated herein by reference in its entirety, an axial DC potential gradient can also be generated by other techniques including a segmented ion guide or auxiliary electrodes inserted between the ion guide rods. Application of an axial DC potential gradient may be useful to keep ions moving in the forward direction and prevent ions from escaping the ion guide 246 through the cell entrance lens 222. Further, the second DC source DC2 applies an exit DC potential to the cell exit lens 224. Additionally or alternatively to the axial DC potential gradient, after transmitting ions into the ion guide 246 for a desired amount of time, the DC potential DC3 applied to the cell entrance lens 222 may be increased to prevent ions from escaping the ion guide 246 through the cell entrance lens 222 and prevent additional ions from being transferred into the ion guide 246 from the ion source 108 (FIG. 1). In other words, the DC potential DC3 applied to the cell entrance lens 222 may be switched between a first magnitude that creates a DC potential barrier effective to prevent ions from entering or exiting the ion guide 246 through the cell entrance lens 222, and a second magnitude that removes (or reduces) the DC potential barrier to allow ions to enter the ion guide 246.

In the operation of an ICP-MS system, ideally only the analyte ions produced in the plasma-based ion source would be transmitted to the mass analyzer. However, as noted earlier in the present disclosure, the ion source also produces background (non-analyte) ions, some of which can act as "interfering ions" in that they interfere with the analysis of a given sample. The interfering ions may be produced from the plasma-forming gas (e.g., argon), matrix components of the sample, solvents/acids included in the sample, and air (oxygen and nitrogen) entrained into the system. Some interfering ions may be produced directly in the collision/reaction cell. As noted, an example of interfering ions are polyatomic interferents that have the same mass as a monatomic analyte ion. The detection of such an interfering ion along with the detection of a certain analyte ion (that the interfering ion interferes with) leads to spectral overlap in the analytical data, thereby reducing the quality of the analysis.

The collision/reaction cell 110 described herein is configured to remove (reduce or eliminate) interfering ions, thereby preventing the interfering ions from being transmitted (or at least reducing the amount of interfering ions transmitted) into the mass analyzer 158. Consequently, the operation of the collision/reaction cell 110 improves the performance of the ICP-MS system 100 and the quality of the mass spectral data produced thereby. The collision/reaction cell 110 may accomplish this by implementing either a physical, nonreactive ion-molecule collision mechanism or a chemically reactive ion-molecule reaction. In an embodiment, the collision/reaction cell 110 is configured to operate in (and be switched between) three different operating modes: a collision mode in which a collision gas is flowed into the collision/reaction cell 110, a reaction mode in which a reaction gas is flowed into the collision/reaction cell 110, and a "no-gas" or standard mode in which no type of collision/reaction gas is flowed into the collision/reaction cell 110. The selection of a specific mode may depend on the type of analyte ion(s) being measured and the type of interfering ion(s), if any, to be removed. By "type" is meant the chemical (elemental) identity of the analyte ion (e.g., calcium, iron, selenium, etc.), and the chemical identity of the interfering ion (e.g. $Ar^+$, $ArO^+$, $Ar_2^+$, etc). In other embodiments, the collision/reaction cell 110 may be configured only (or primarily) for collision operations, or only (or primarily) for reaction operations.

In the no-gas mode, the collision/reaction cell 110 is utilized only as an ion guide to transport analyte ions to the mass analyzer 158. That is, the ion guide 146 is operated in the absence of a collision/reaction gas. The no-gas mode may be useful when interfering ions are not present such that a collision or reaction operation to suppress interferences is not needed.

In the operation of the collision mode or the reaction mode, a flow of collision/reaction gas is established into the collision/reaction cell 110 via the collision/reaction gas source 138 and collision/reaction gas feed conduit and port 142. The gas flow rate may be set to be optimized for the specific element (analyte ion) being measured. The gas flow rate may depend on other factors such as, for example, the type(s) and the intensity (or intensities) of interfering ion(s) anticipated to be removed. While the collision/reaction gas is flowing into the collision/reaction cell 110, the ion beam 106 is transmitted into the collision/reaction cell 110 via the cell entrance lens 122 and into the ion guide 146. The ion beam 106 includes both analyte ions and various non-analyte ions. If one of the non-analyte ion species has the same m/z ratio as the analyte ion to be measured, the non-analyte ion interferes with the analyte ion detection as a background ion. Since the formation of each non-analyte ion species depends on the sample under analysis and the operating conditions of the sample introduction section 104 and ion source 108, the ion beam 106 may or may not include interfering ions. While the ion beam 106 is being transmitted into the collision/reaction cell 110, the ion guide 146 is actively powered to generate the RF confining field described above, which radially confines the ion beam 106 along the central longitudinal axis of the ion guide 146. The collision/reaction gas interacts with ions in the ion beam 106 inside the ion guide 146. Depending on the configuration or mode of operation of the collision/reaction cell 110, this interaction involves either ion-molecule collisions or ion-molecule reactions. A resulting ion beam 166 then exits the ion guide 146 and the collision/reaction cell 110 via the cell exit lens 124, and is directed into the mass analyzer 158 where the ions undergo mass analysis in the manner described above. Ideally, this outgoing ion beam 166 should have none (or at least a much lower concentration) of the interfering ions from the incoming ion beam 106, and should have no (or at least a minimal amount of) interfering ions that were newly formed directly in the collision/reaction cell 110.

In an embodiment, the reaction mode is based on the relative reaction rates of the reactive gas with the analyte ion and the interfering ion. For example, if reactions with interfering ions are exothermic, whereas reactions with analyte ions are endothermic, reactions with interfering ions can be rapid, whereas the reactive gas is effectively unreactive with the analyte ions or may be completely unreactive with the analyte ions. The particular type of reaction that occurs (e.g., charge transfer, proton transfer, etc.) depends on the type of reactive gas utilized and the type of interfering ion to be removed. Typically, the reaction converts the interfering ion to either a non-interfering ion or a neutral species. The conversion of an interfering ion to a non-interfering ion involves changing the composition of the interfering ion, thereby changing the mass of the interfering ion to a mass different from (and thus no longer interfering with) the mass of the analyte ion. In the case of converting an interfering ion to a neutral species, the neutral species is not influenced by electrical or magnetic fields. Thus, the neutral species can be removed by the vacuum system (e.g., via port 132 or port 136) along with other neutral gas molecules, and in any event is "invisible" to the mass analyzer 158. An example is the use of hydrogen gas $H_2$ to convert the argon ion $^{40}Ar^+$ which interferes with the calcium isotope $^{40}Ca^+$, to the neutral argon atom Ar via charge transfer from the argon ion to the hydrogen molecule: $H_2+{}^{40}Ar^+ \rightarrow Ar+H_2^+$.

In another embodiment of the reaction mode, the ion-molecule reaction involves the analyte ion instead of the interfering ion. That is, the reaction converts the analyte ion to a new analyte ion species, i.e., changes the composition of the original analyte ion. The new analyte ion species has a mass different from (typically higher than) the mass of the original analyte ion species, and hence also different from the mass of the interfering ion. Reaction with the analyte ion may also be characterized as, in effect, the conversion of the interfered ion to a non-interfered ion. The new analyte ion (or "product ion") is detected and becomes part of the mass spectrum, and provides useful information because it corresponds to the original monatomic analyte ion under investigation.

Generally, the reaction mode is a mode where the collision/reaction gas is reactive with the ion of interest, which is either an interfering ion or the analyte ion depending on which type of ion the gas is reactive with, as just described. In an embodiment of the reaction mode, in addition to serving as a reactive gas for the ion of interest, the collision/reaction gas also serves as a collision gas for the unreactive ion. Thus, in the case where the gas reacts with an interfering ion, the gas may serve as a collision gas for the unreactive analyte ion. On the other hand, in the case where the gas reacts with the analyte ion, the gas may serve as a collision gas for the resulting, unreactive product ion.

As noted earlier in this disclosure, the collision/reaction cell 110 is filled with the reactive gas at a certain pressure to obtain sufficient efficiency of reaction with either the interfering ion or the analyte ion (derived from the element being investigated). However, the optimum pressure (or gas density) for carrying out the interference-suppressing reaction often varies for different elements. Therefore, it has been conventional to change (adjust) the flow rate of the reaction gas into a collision/reaction cell when different elements are measured, so as to obtain an acceptably high signal-to-background (S/B) ratio for each element. It has also been conventional to operate a collision/reaction cell as a continuous-beam instrument. That is, a conventional collision/reaction cell is configured to confine the ions in the radial direction only (using the RF confining field generated by the multipole ion guide in the collision/reaction cell), and not in the axial direction. Therefore, conventionally the residence time of a given ion in a collision/reaction cell, and thus the time of reaction between the collision/reaction gas and the ion, has been dictated by the transit time taken by the ion in traveling from the cell entrance to the cell exit, and the residence/reaction time has not been actively controlled.

According to an aspect of the present disclosure, instead of controlling the gas flow rate (and thus the gas density in the collision/reaction cell 110), the reaction time (i.e., the residence time of ions in the collision/reaction cell 110) is controlled. In other words, instead of varying the gas flow rate to achieve optimal reaction conditions for each different element under analysis, the reaction time is varied (adjusted) as needed to achieve optimal reaction conditions for each different element under analysis. The reaction time is extended by confining ions in the collision/reaction cell 110 in the axial direction as well as the radial direction for a certain confinement period. The confinement period has a desired duration that seeks to obtain sufficient efficiencies of interference-suppressing reactions for each specific type of analyte ion to be measured. According to an embodiment, all ions (analyte and non-analyte) entering the collision/reaction cell 110 are axially confined in the ion guide 146 (or 246) by creating a high positive exit DC potential (a DC potential barrier) at the cell exit for the duration of the desired (predetermined) confinement period. In an embodiment, the DC potential barrier is created by applying the exit DC potential at the cell exit lens 124 (or 224). Additionally, the confined ions may be prevented from exiting the collision/reaction cell 110 through the cell entrance during the confinement period by applying an axial DC potential gradient along the ion guide 146, and/or by applying a high entrance DC potential at the cell entrance lens 122 (or 222), as described above in conjunction with FIG. 3. In addition, the ions are radially confined by applying the RF confining field generated by the ion guide 146 as described above. Therefore, the ions are completely confined in the ion guide 146 during the confinement period.

Storing ions in the collision/reaction cell 110 in this manner for a confinement period of desired duration may ensure that a sufficient number of reactions between the collision/reaction gas and the target interfering ion (or the analyte ion, depending on the embodiment) have occurred. The confinement may thus result in a greater reduction of interferences, and thus an increased S/B ratio, in comparison to conventional collision/reaction cells which, as noted, do not store or confine ions. Moreover, the confinement period causes the analyte ions (or the analyte product ions if the reaction is between the analyte ions and the collision/reaction gas) to collide with the collision/reaction gas molecules a number of times that is effective to slow down the analyte ions (or product ions) through loss of kinetic energy, thereby enhancing the confinement of the analyte ions (or product ions) in the collision/reaction cell 110 during the confinement period.

After a sufficient number of reactions with the target interfering ion (or the analyte ion, depending on the embodiment) have occurred, the confinement period is terminated by quickly removing (or quickly reducing the positive magnitude of) the high DC potential applied at the cell exit to allow the confined ions to flow out of the collision/reaction cell 110 and be mass-analyzed and detected/counted during a subsequent measurement period. The mass analyzer 158 can be configured to send only the target analyte ions (or product ions) to the ion detector 161 for measurement, and reject all other ions received by the mass analyzer 158.

Thus, the present disclosure encompasses a method for operating a collision/reaction cell that includes a confinement period followed by a measurement period, with the transition between the confinement period and the measurement period entailing a very short time interval during which the high exit DC potential (DC potential barrier) at the cell exit is removed (or reduced). In an embodiment, the creation and subsequent removal (or reduction) of the high exit DC potential may be characterized as: applying an exit DC potential at the cell exit at a first magnitude to generate a DC potential barrier that is effective to prevent the ions from exiting the collision/reaction cell 110, maintaining the exit DC potential at the first magnitude for the duration of the confinement period (with the duration being optimal for the analyte ion interfered with), and after the confinement period, switching (adjusting) the exit DC potential from the first magnitude to a second magnitude that is effective to allow the analyte ions to pass through the cell exit and to the mass analyzer 158.

In various embodiments, the first DC potential magnitude and the second DC potential magnitude have one or more of the following attributes: the second DC potential magnitude is more negative than the first DC potential magnitude; the first DC potential magnitude is a positive or zero magnitude and the second DC potential magnitude is a negative or zero magnitude; the first DC potential magnitude is in a range from 0 V to +100 V; and/or the second DC potential magnitude is in a range from −200 V to 0 V.

Generally, the duration of the confinement period is as long as needed to ensure the interaction between the collision/reaction gas and the interfering ions or analyte ions optimizes or maximizes the suppression of the interference. As non-exclusive examples, the confinement period may have a duration in a range from 0 ms to 1000 ms, or 5 ms to 500 ms, or 10 ms to 100 ms. The duration of the confinement period depends on (and hence may be selected based on) the analyte ion being analyzed, and may differ for different analyte ions. Confinement period durations for different analyte ions may be determined empirically through appropriate experimental runs of sample elements through the ICP-MS system 100. Confinement period durations for different analyte ions may be provided by a memory of the system controller 120, such as in a look-up table or database stored in or accessible by memory of the system controller 120. Confinement period durations for different analyte ions may be instrument-dependent. That is, the confinement period duration for a given analyte element to be analyzed by one ICP-MS system may be different than the confinement period duration for the same analyte element to be analyzed by another ICP-MS system, even if the other ICP-MS system is configured the same as the first ICP-MS system.

Generally, the time interval required to switch the DC potential from the first magnitude to the second magnitude at the cell exit is limited only by the transient delay exhibited by the electronics utilized to apply the DC potential. As one non-exclusive example, the switching may have a duration in a range from 0.01 ms to 0.1 ms.

As another aspect of the presently disclosed subject matter, the abrupt switching of the DC potential from the first magnitude to the second magnitude (and the difference between the first magnitude and the second magnitude) causes the analyte ions to exit the collision/reaction cell 110 as a pulse having a certain, short pulse duration. As one non-exclusive example, the pulse duration may be in a range from 0.1 ms to 1 ms. In an embodiment, the effect of abruptly switching the DC potential in this manner may be characterized as ejecting an ion pulse (or ion packet) from the collision/reaction cell 110.

Figure 4:
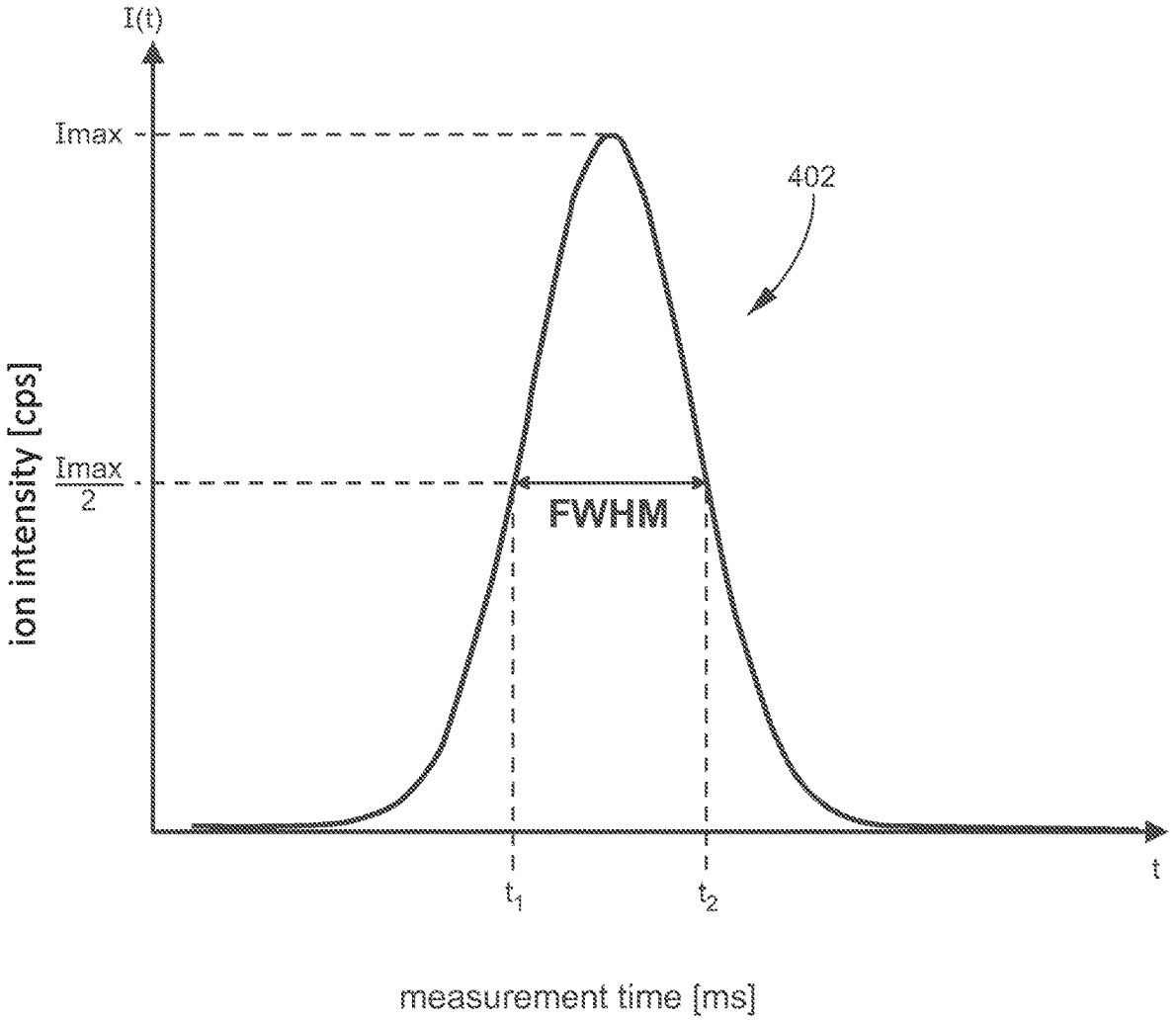
FIG. 4 is a schematic illustration of a pulse peak, defined as ion intensity (in counts per second, or cps), I, as a function of measurement time (in ms), t, as may be measured by a mass spectrometer.

In an embodiment, the duration of the measurement period during which the analyte ions are measured or counted is no longer than, or is approximately equal to (approximately the same as) the pulse duration. In the present context, the pulse duration may be equal to or longer than a full width at half maximum (FWHM) of the pulse peak, but may be equal to or shorter than about five times the FWHM, depending on the pulse shape. "Approximately equal to" (or "approximately the same as," "close to," "about," and like phrases) may mean that the duration of the measurement period is a value in a range from the FWHM of the pulse peak to five times the FWHM. For example, if the FWHM for the pulse is 0.2 ms, an approximately equal measurement period duration may be in a range from 0.2 ms to 1.0 ms, where the endpoints 0.2 ms and/or 1.0 ms may be included in the range. An example of FWHM is illustrated in FIG. 4. Specifically, FIG. 4 is a schematic illustration of a pulse peak 402, defined as ion intensity (in counts per second, or cps), I, as a function of measurement time (in ms), t, as may be measured by a mass spectrometer. The apex of the pulse peak 402 corresponds to the maximum intensity value $I_{max}$ of the ion signal for this pulse peak 402. Half of the maximum intensity value is indicated as $I_{max}/2$. The FWHM of the pulse peak 402 is the width of the peak at $I_{max}/2$, corresponding to a time duration of $(t_1-t_2)$.

Setting the measurement period duration to be approximately equal to the pulse duration may help ensure that the S/B ratio is improved as a result of implementing the confinement period disclosed herein. After the pulse duration, the signals of the analyte and interfering ions stabilize at their steady state levels, providing an unimproved S/B ratio, i.e., the same S/B ratio as obtained from a conventional collision/reaction cell. Therefore, if the measurement period is extended to a post-pulse period, the S/B ratio will be degraded toward the value obtained from the conventional collision/reaction cell. Or, as mentioned in one of the previous embodiments, the increased DC potential DC3 may be applied to the cell entrance lens 222 to prevent additional ions from being transferred into the ion guide 246. If the increased DC potential DC3 is maintained even after the pulse duration, no ion signal is observed when the pulse is over. In this case, the measurement after the pulse period is not useful.

The measurement period may be controlled to be approximately equal to the pulse duration of the collision/reaction cell 110 when utilizing either a continuous-beam mass analyzer (e.g., a quadrupole mass filter, sector instrument, or the like) or a non-continuous beam mass analyzer (e.g., a TOF analyzer, ion trap-based analyzer, etc.). In either case, only the pulsed portion of the ion beam from the collision/reaction cell 110 is measured by the mass analyzer to thereby achieve a higher S/B ratio and/or S/N ratio. In the present context, the duration of the measurement period may be considered to be the duration of the ion injection into the mass analyzer, which is limited (at least approximately) to the pulse duration of the collision/reaction cell 110. It will be understood that this pulse duration is not necessarily the same as any "pulsed" operation of a non-continuous beam mass analyzer, such as the subsequent extraction pulse into the flight tube of a TOF analyzer, ion flight time through the flight tube of a TOF analyzer, or trapping time in a trap-based analyzer.

As another aspect of the presently disclosed subject matter, as ions continue to enter the collision/reaction cell 110 from the ion source 108 during the confinement period, they accumulate in the collision/reaction cell 110. As noted above, the ion signal obtained after the confinement is an intense short pulse. Depending on the duration of the confinement period, the peak intensity of this pulse is 10 to 300 times higher than the ion signal normally observed without confinement. However, the noise (electrical noise and neutral noise derived from non-ionic sources) is not confined or accumulated. Therefore, signal-to-noise (S/N) ratios are improved by the confinement for any ions, whether spectrally interfered with or not. Ideally, the spectrometer output should be zero when the analyte concentration is zero (when the blank is measured). However, this is not the case in actual practice. The non-zero output, so called "background," is caused by many factors in ICP-MS, such as the analyte contamination in the ICP-MS system, interfering ions, stray ions in the vacuum chamber, photons from the plasma, high-energy neutrals (mainly Ar atoms), electrical noise, etc. The high-energy neutrals, produced in the ion optics section 114, may be energetic enough to generate secondary particles from collision with surfaces or gas molecules in the vacuum chamber. The secondary particles can be electrons or ions from the surface, which result in noise when they reach the ion detector 161. The electrical noise may be shot noise of the ion detector 161 (e.g., spontaneous emission of electrons from a dynode in the electron multiplier), thermal noise of the ion counting electronics, or the noise originating from micro-discharges by the high-voltage components. The background generated by these non-ionic sources (photons, neutrals, electrical noise), often referred to as "random noise", appears in mass spectra as a mass-independent jaggy offset from the zero level (does not appear as a mass spectral peak). The contributions of the random noise to the background is often much smaller than that of interfering ions when the target analyte suffers the interfering ions. However, for non-interfered analyte ions, the random noise can contribute significantly to the background. Unlike the ions, the random noise is not confined or accumulated in the collision/reaction cell 110. Therefore, S/N ratios are improved by measuring the confined ions as a pulse.

Accordingly, the ion confinement followed by pulsing in a collision/reaction cell, as provided by embodiments disclosed herein, provides advantages when measuring non-interfered analyte ions in the collision mode as well as when measuring the interfered analyte ions in the reaction mode. That is, the background for non-interfered analyte ions is mostly due to neutral noise and electrical noise. Since there are no interfering ions, the ions confined in the collision/reaction cell 110 are the analyte ions only, and the neutrals are not confined. Therefore, the ion confinement followed by pulsing improves the S/N ratio when operating in the collision mode.

In an embodiment, transmission of the ions through the cell entrance and into the collision/reaction cell 110 continues to occur during the confinement period by keeping an entrance DC potential at a second magnitude. The entrance DC potential at the second magnitude is effective to allow ions to transmit through the cell entrance. That is, after the initiation of the confinement period, ions from the ion source 108 are permitted to continue to enter the collision/reaction cell 110. Therefore, the analyte ions accumulate in the collision/reaction cell 110, thereby increasing the number of analyte ions in the ion pulse and thus the peak intensity of the ion pulse that occurs at the end of the confinement period.

In another embodiment, an entrance DC potential at a first magnitude is applied at the cell entrance (e.g., at the cell entrance lens 122 as described above) during at least a latter part of the confinement period (i.e., a portion of the confinement period that includes the end of the confinement period). The entrance DC potential at the first magnitude is effective to prevent the confined analyte ions from exiting the collision/reaction cell 110 through the cell entrance and at the same time prevent interfering ions from entering the collision/reaction cell 110 through the cell entrance.

Alternatively or additionally, an entrance DC potential at a first magnitude may be applied at the cell entrance during the measurement period. The entrance DC potential at the first magnitude is effective to prevent interfering ions from entering the collision/reaction cell 110 through the entrance.

The presently disclosed subject matter may be implemented in a multi-element analysis. Thus, after analyzing elements of a first type, the method may be repeated to analyze elements of a second type, and so on. The confinement period durations for different elements may differ as described above, and thus may be adjusted for each type of element to be analyzed. Such adjustments can be much quicker than the adjustment of gas flow rates which usually takes more than a several seconds, and may be effected by the system controller 120, which controls the operation of the ICP-MS 100, according to a predetermined program developed as part of the method development for the sample run. The type of collision/reaction gas to be utilized may also differ for different elements. Thus, the method may entail switching the type of collision/reaction gas for different elements, which may also be part of the programming and provided as operating parameters in the above-noted look-up table, database, or memory. The system controller 120 may control the collision/reaction gas source 138 for this purpose. Notably, interference suppression may not be needed for certain elements, in which case no selection of a collision/reaction gas is made as to those elements and instead the collision/reaction cell 110 is operated in the no-gas mode as an ion guide.

Accordingly, in an embodiment of the method that implements multi-element analysis, the analyte ions include at least first analyte ions of a first mass and second analyte ions of a second mass different from the first mass. A flow of collision/reaction gas into the collision/reaction cell 110 is established. Ions, including at least the analyte ions, are transmitted into the collision/reaction cell 110. An exit DC potential is applied at a first magnitude at the cell exit for a first confinement period of a first duration, to thereby generate a DC potential barrier that is effective to prevent the ions from exiting the collision/reaction cell 110 during the first confinement period, as described herein. During the first confinement period, the collision/reaction gas is reacted with first interfering ions that interfere with the first analyte ions, or the collision/reaction gas is reacted with the first analyte ions, to suppress interference. That is, an interaction is performed that is effective to suppress interfering ion signal intensity that is to be measured by the mass spectrometer (e.g., the mass analysis section 118 shown in FIG. 1), as described herein. The interaction may involve reacting the interfering ions with the collision/reaction gas, or reacting the analyte ions with the collision/reaction gas, in the manner described herein. After the first confinement period, a first pulse of ions is transmitted to the mass spectrometer. This is done by switching the exit DC potential to a second magnitude that is effective to allow the first analyte ions (or product ions formed from the first analyte ions) to pass through the cell exit as a pulse. The first pulse includes at least the first analyte ions (or product ions derived therefrom), but may also include other ions such as the second analyte ions if mass selection upstream of the (final) mass analyzer 158 is not implemented. Then, at least the first analyte ions (or product ions derived therefrom) contained in the first pulse are measured by the mass spectrometer. For example, as described herein, the mass analyzer 158 may be configured (e.g. tuned) to send only the first analyte ions (or product ions derived therefrom) to the ion detector 161 for measurement, and reject all other ions received by the mass analyzer 158.

Continuing with this embodiment, after measuring the first analyte ions contained in the first pulse, the exit DC potential is again applied at the cell exit at the first magnitude for a second confinement period of a second duration different from the first duration. During the second confinement period, the collision/reaction gas is reacted with second interfering ions that interfere with the second analyte ions, or with the second analyte ions, to suppress interference. After the second confinement period, a second pulse is transmitted to the mass spectrometer by switching the exit DC potential to the second magnitude. The second pulse includes at least the second analyte ions (or product ions derived therefrom), but may also include other ions such as the first analyte ions if mass selection upstream of the (final) mass analyzer 158 is not implemented. Then, at least the second analyte ions (or product ions derived therefrom) contained in the second pulse are measured by the mass spectrometer. As an example, at this time, the mass analyzer 158 may be tuned to send only the second analyte ions (or product ions derived therefrom) to the ion detector 161 for measurement, and reject all other ions received by the mass analyzer 158.

The method just described may be repeated for additional analyte ions to analyze additional elements of the sample.

In another embodiment of the method that implements multi-element analysis, the method may also implement mass selection before the mass analyzer 158, such as before the collision/reaction cell 110. For example, the ICP-MS 100 may be configured as a QQQ system as described herein. As an example of this embodiment, only the first analyte ions are transmitted into the collision/reaction cell 110, without the second analyte ions or other analyte ions, by implementing an appropriate technique of mass selection. The first analyte ions (and any first interfering ions that interfere with the first analyte ions) are then confined during the first confinement period as described above. During the first confinement period, interference-suppressing interactions are performed as described above. Subsequently, the first analyte ions (or product ions) are transmitted in a first pulse to the mass spectrometer and measured as described above. After measuring the first analyte ions, the second analyte ions are transmitted into the collision/reaction cell 110, without the first analyte ions or other analyte ions, by implementing mass selection. The second analyte ions (and any second interfering ions that interfere with the second analyte ions) are then confined during the second confinement period. During the second confinement period, interference-suppressing interactions are again performed. Subsequently, the second analyte ions (or product ions) are transmitted in a second pulse to the mass spectrometer and measured. This method may be repeated for additional analyte ions to analyze additional elements of the sample.

During the confinement period, the reaction of the interfering ions (or analyte ions, depending on the embodiment) with reactive gas proceeds so that analyte ion signal can be measured with reduced interfering ion intensity (reduced background). Namely, the interfering ion intensity can be reduced without increasing the gas flow rate, or without needing to adjust the gas flow rate for different analyte elements to be measured. In other words, with a fixed reaction gas flow rate that is sufficient for the "easiest" element, other more "difficult" elements can be measured with improved reaction efficiencies by confining each of them in the collision/reaction cell 110 for a confinement period duration that is appropriate for each element. For example, the intensities of interfering ions, $^{40}Ar^{+}$ and $^{40}Ar^{16}O^{+}$, produced in the Ar-plasma, are typically about $10^{10}$ and $10^{7}$ counts per second, respectively. The signal intensities of the interfered analyte ions, $^{40}Ca^{+}$ and $^{56}Fe^{+}$ respectively, are in the same order of magnitude. Therefore, the interference on Ca is more intense than that on Fe. A higher flow rate of the reaction gas is necessary to suppress $Ar^{+}$ to the same level as $ArO^{+}$ so that similarly improved S/B ratios are obtained for Ca and Fe. In this sense, Ca is a more difficult element than Fe. The same reaction gas, for example $H_2$ or $NH_3$ or $H_2O$, is available to reduce both $Ar^{+}$ and $ArO^{+}$. Then, for example, with a flow rate of $H_2O$ set to the optimum value for $Fe^{+}$ (the "easier" element) on $ArO^{+}$, which is lower than the value required for $Ca^{+}$ on $Ar^{+}$, $Ca^{+}$ ion pulse measurement followed by $Ca^{+}$ confinement enables Ca analysis without increasing the $H_2O$ flow rate.

Accordingly, an embodiment of the method entails flowing the collision/reaction gas into the collision/reaction cell during a first confinement period (for analyzing a first element) at a certain gas flow rate, and flowing the collision/reaction gas into the collision/reaction cell during a second confinement period (for analyzing a second element) without changing the gas flow rate. The gas flow rate may remain unchanged in the analysis of additional elements (third element, fourth element, and so on), while the duration of the confinement period may be adjusted for each additional element as needed for optimizing the reaction conditions for each additional element.

Example of Operation

Figure 5A:
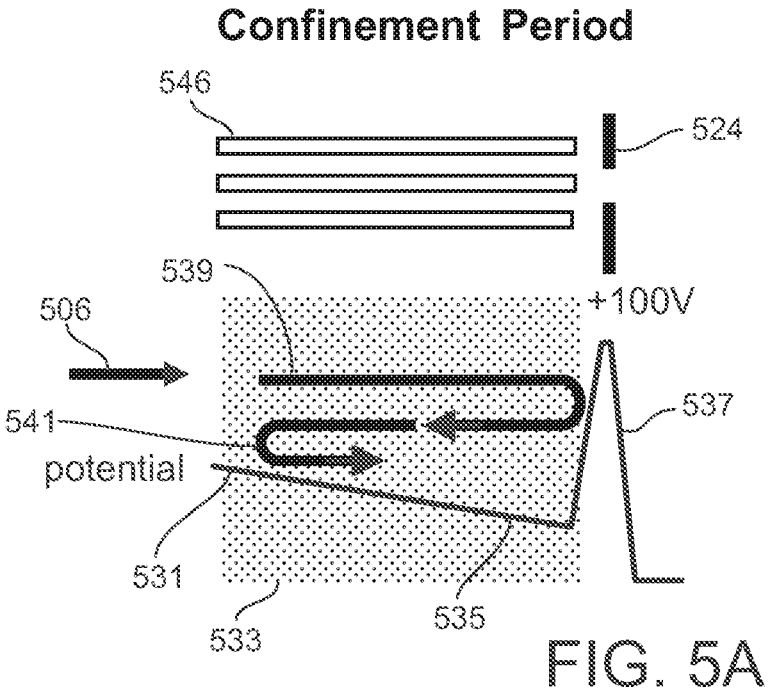
FIG. 5A is a schematic diagram illustrating an ion guide and a cell exit lens of a collision/reaction cell, and a DC potential along the axial length of the ion guide and to the cell exit lens, during a confinement period, according to an embodiment of the present disclosure.
Figure 5B:
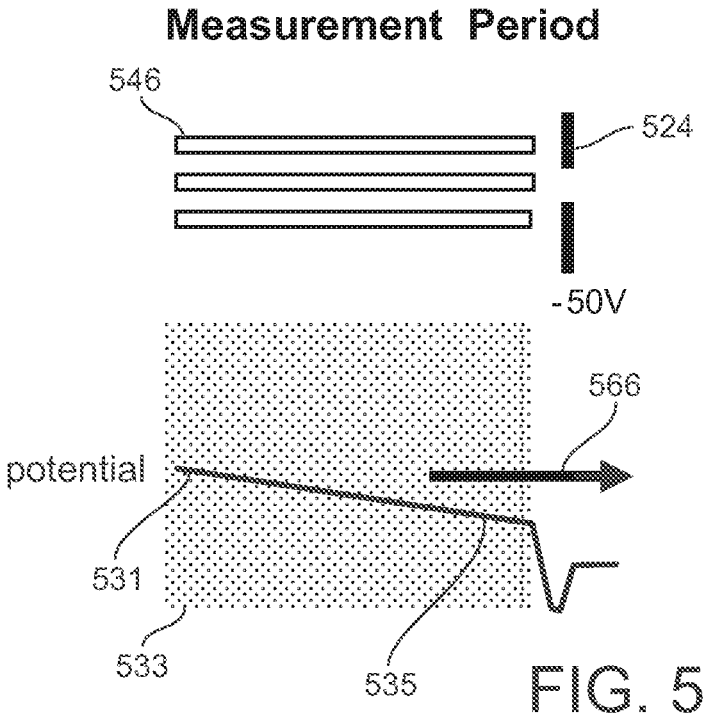
FIG. 5B is a schematic diagram illustrating the same collision/reaction cell illustrated in FIG. 5A, and the DC potential during a measurement period, according to an embodiment of the present disclosure.

One non-exclusive example of operating a collision/reaction cell according to the present disclosure will now be described with reference to FIGS. 5A and 5B. FIG. 5A is a schematic diagram illustrating an ion guide 546 and a cell exit lens 524 of a collision/reaction cell, and the DC potential 531 along the axial length of the ion guide 546 and to the cell exit lens 524, during the confinement period. FIG. 5B is a schematic diagram illustrating the same collision/reaction cell illustrated in FIG. 5A, and the DC potential 531 during the measurement period. In the present example, the portion of the DC potential 531 along the axial length of the ion guide 546 is an axial DC potential gradient 535, by which the magnitude of the DC potential 531 gradually ramps down (becomes more negative) along the axis in the direction toward the cell exit lens 524. The axial DC potential gradient 535 may be maintained during both the confinement period (FIG. 5A) and the measurement period (FIG. 5B). FIGS. 5A and 5B also depict a collision/reaction gas 533 in the housing (not shown) of the collision/reaction cell, with the gas molecules being represented by dots.

During the confinement period (FIG. 5A), ions 506 (analyte ions and interfering ions, if any) travel into the ion guide 546 and are radially constrained by the RF field applied by the rod electrodes of the ion guide 546 as described herein. An exit DC potential of a first magnitude (+100 V in the present example) is applied to the cell exit lens 524, thereby creating a DC potential barrier 537 at the cell exit lens 524. The ions 506 enter the cell having a certain kinetic energy, travel through the ion guide 546, are reflected by the DC potential barrier 537, and travel back toward the entrance of the ion guide 546 as depicted by an arrow 539. During this stroke, the ions slow down through multiple collisions with the collision/reaction gas and some of them even come to a stop, thus being confined in the cell. Additionally, if the axial DC potential gradient 535 is generated, some of the reflected ions are repelled and urged back toward the exit of the ion guide 546, thereby being confined near the cell exit, as depicted by another arrow 541. The DC potential barrier 537 is maintained throughout the confinement period, the duration of which is determined as described elsewhere in the present disclosure.

In the case of the reaction mode of operation, the collision/reaction gas 533 is a reactive gas. The reactive gas reacts with the unwanted interfering ions (background ions), but does not react with the isobaric interfered analyte ions (signal ions). After a sufficient confinement period, which corresponds to the reaction time for the interfering ions, most of the interfering ions have been eliminated through reaction with the gas, and the analyte ions remain confined as described in the previous paragraph. Consequently, the ratio of analyte ion density to interfering ion density in the collision/reaction cell has increased, and the analyte ions are measured with an improved S/B ratio during the subsequent measurement period. Alternatively, the ions measured are product ions produced by reaction between the analyte ions (which are reactive in such case) and the gas. In this case, the analyte ions react with the reaction gas and the resultant product ions, which do not react with the gas anymore, are confined in the cell during the confinement period.

After the desired amount of confinement period duration, the operation of the collision/reaction cell is switched from the confinement period to the measurement period by rapidly removing (or at least reducing) the DC potential barrier 537 to allow analyte ions 566 to exit the collision/reaction cell and enter the downstream mass analyzer (not shown), as shown in FIG. 5B. The DC potential barrier 537 is removed by rapidly switching the exit DC potential on the cell exit lens 524 from the first magnitude to a lower, second magnitude (−50 V in the present example). In this manner, an intense short ion pulse is obtained during the measurement period, which is available for ion measurement with an improved S/N ratio.

The axial DC potential gradient 535 may be applied to improve ion confinement efficiency during the confinement period and ion ejection efficiency during the measurement period.

EXPERIMENTAL EXAMPLES

An experiment was performed to evaluate the collision/reaction cell and method for operating it as described herein. A solution of cobalt (Co), yttrium (Y), and thallium (Tl) at 1 parts-per-billion (ppb) was injected into an argon (Ar) plasma, and the resulting ions were transmitted into the collision/reaction cell. Oxygen gas ($O_2$) was bled into the collision/reaction cell at a flow rate of 0.45 standard cubic centimeters per minute (sccm) to examine the generation of short intense ion pulses. $O_2$ acts as a collision gas for $Co^+$ and $Tl^+$, since these two ions do not react with $O_2$, and as a reaction gas for $Y^+$, since $Y^+$ reacts with $O_2$ to form a product ion $YO^+$, which no longer reacts with $O_2$. Therefore, $Co^+$, $YO^+$ and $Tl^+$ were confined in the cell during a confinement period implemented as described herein.

Figure 6A:
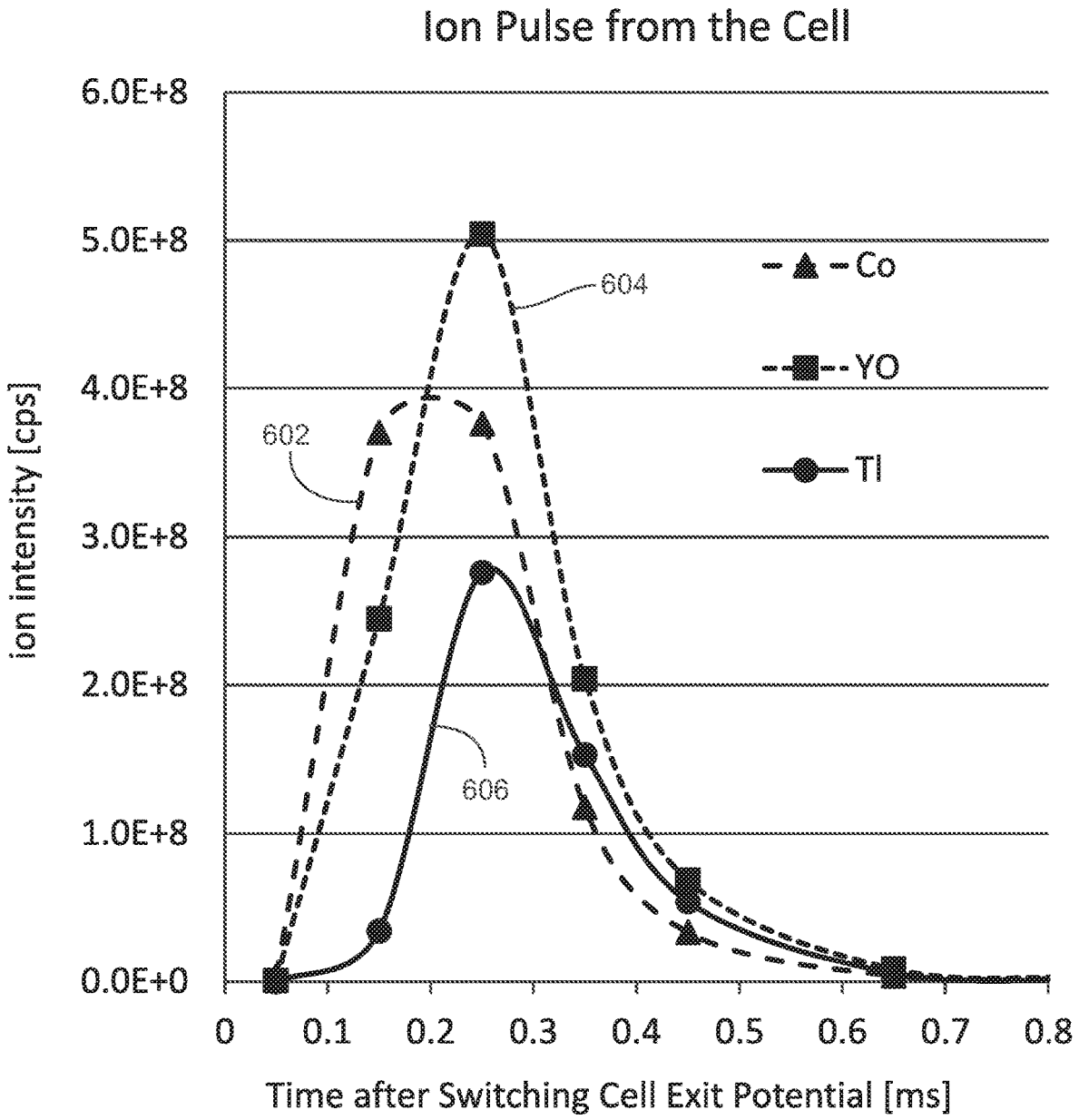
FIG. 6A is a set of curves representing the ion pulses generated from a collision/reaction cell as described herein filled with oxygen gas, into which $Co^+$, $Y^+$, and $Tl^+$ ions are injected during a confinement period and a subsequent measurement period according to the present disclosure.
Figure 6B:
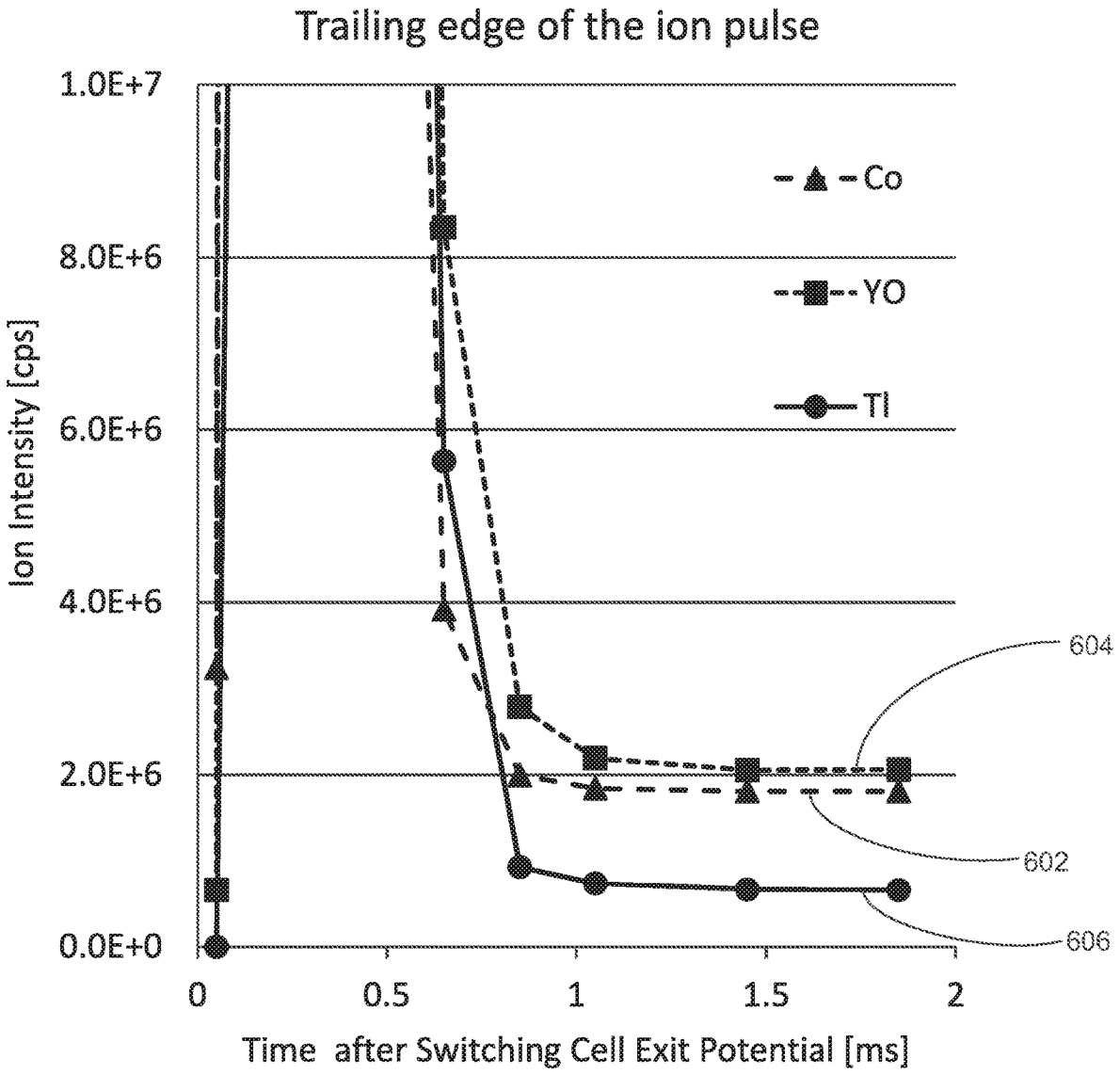
FIG. 6B is a set of curves representing the trailing edges of the ion pulses shown in FIG. 6A.

FIGS. 6A and 6B show the ion pulses of $Co^+$, $YO^+$ and $Tl^+$ that were ejected from the collision/reaction cell after the confinement period of 60 ms by switching the exit DC potential from +100V to −50V in about 0.05 ms. Specifically, FIG. 6A is a set of curves (ion signal intensity in counts per second, or cps, as a function of time after switching cell exit potential in ms) representing the ion pulses measured for the $Co^+$ ions (curve 602), the $YO^+$ ions (curve 604), and the Tr ions (curve 606), and FIG. 6B is a set of curves representing the trailing edges of the three ion pulses shown in FIG. 6A. A negative entrance DC potential was applied at the cell entrance lens during both the confinement and measurement periods to allow ions to continue to enter the cell. From about 0.1 ms to 0.8 ms after the end of confinement period (the beginning of the measurement period), ion pulses of sub-ms width were detected. The pulse peak height was $4\times10^8$ counts per second (cps) for $Co^+$, $5\times10^8$ cps for $YO^+$, and $2.8\times10^8$ cps for $Tl^+$ as shown in FIG. 6A. These intensities (count rates) were more than two orders of magnitude higher than the steady-state signal levels (1 to $2\times10^6$ cps), which were observed for the three ions after the pulses as shown in FIG. 6B (from 1 ms to 1.8 ms).

Another experiment was performed to evaluate the collision/reaction cell and method for operating it as described herein. A blank solution (deionized water, DIW) was injected into an argon (Ar) plasma, and the resulting ions were transmitted into the collision/reaction cell and mass-analyzed to measure the ions of m/z=40, which are $^{40}Ar^+$ ions. Next, a 0.1 parts-per-billion (ppb) calcium solution was injected into an argon (Ar) plasma, and the resulting ions were transmitted into the collision/reaction cell and mass-analyzed to measure the ions of m/z=40, which are mixture of $^{40}Ar^+$ and $^{40}Ca^+$ ions. Therefore, the argon ion $^{40}Ar^+$ interferes with the calcium ion $^{40}Ca^+$ at m/z=40. Water vapor ($H_2O$) was utilized as the reaction gas to suppress this interference. The water vapor was bled into the collision/reaction cell at a fixed flow rate of 0.1 milligrams per minute (mg/min) together with helium (He) gas. Collisions with this additional helium gas may promote the slowing down of $Ca^+$ ions for efficient confinement, and the slowing down of $Ar^+$ ions for efficient reaction with $H_2O$. The argon ion $^{40}Ar^+$ is converted to the non-interfering neutral argon atom Ar via charge transfer from the argon ion $^{40}Ar^+$ to the water molecule. On the other hand, the water vapor does not react with the calcium ion $^{40}Ca^+$. Thus, the reactions involved with interference suppression in this example are:

$$H_2O+Ar^+\rightarrow H_2O^++Ar$$

$$H_2O+Ca^+\rightarrow \text{no reaction}$$

Therefore, during the confinement period, $Ca^+$ ions are confined and accumulated in the cell, and $Ar^+$ ions react with water, thereby reducing the abundance of $Ar^+$ ions in the cell. The exit DC potential applied at the cell exit lens was switched from +100V to −50V in about 0.05 ms to start a measurement period. The measurement duration (ion counting period) was set to 0.5 ms, which corresponds to the expected pulse duration such as shown in FIG. 5A.

Figure 7:
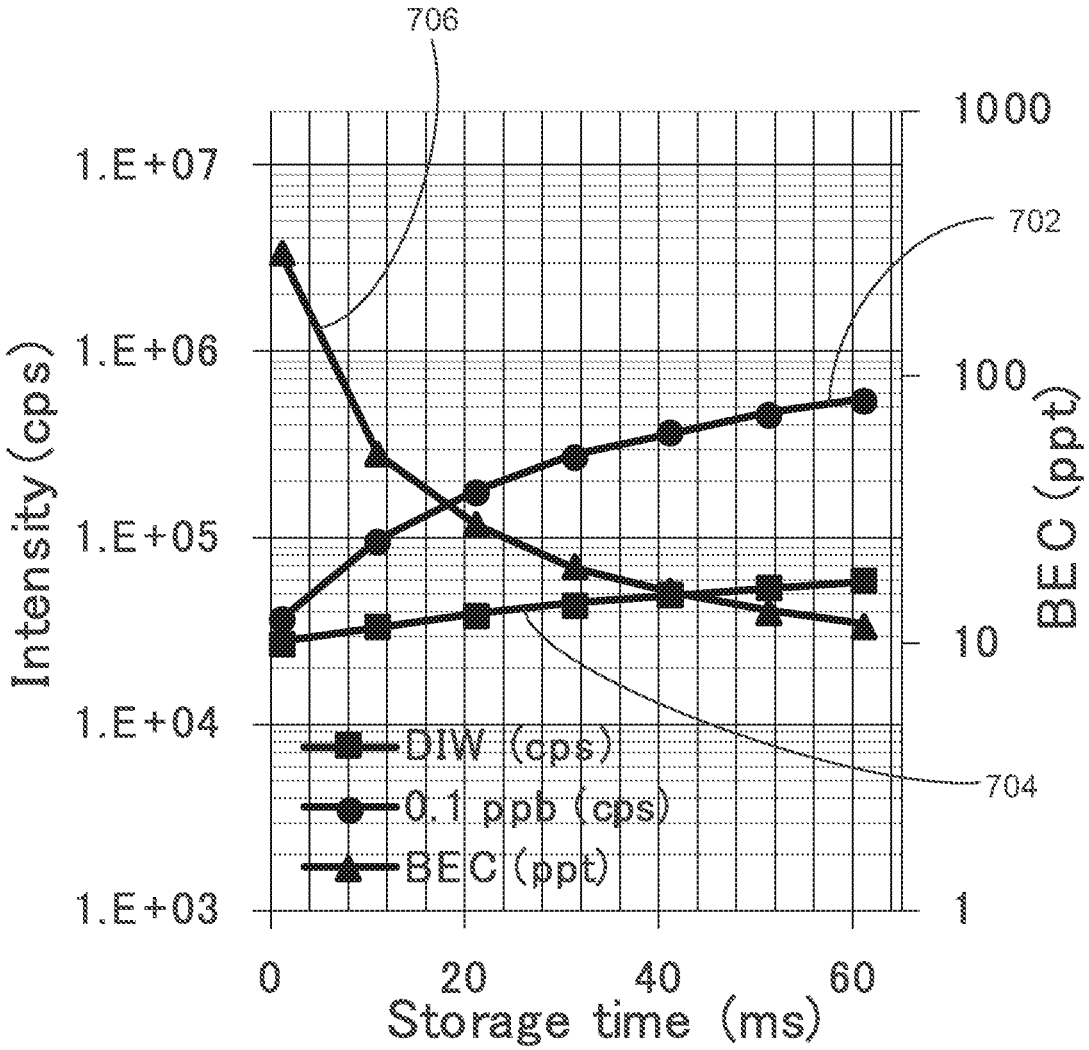
FIG. 7 is a set of curves representing the $^{40}Ca^+$ ion signal intensity (in cps) at m/z=40 from the 0.1 ppb calcium solution as a function of ion confinement duration (or storage time, or reaction time, in ms) in the collision/reaction cell, the interfering background ion ($^{40}Ar^+$ ion) intensity from deionized water (DIW), or blank, as a function of ion confinement duration, and the calculated background equivalent concentration or BEC (in ppt) as a function of ion confinement duration.

FIG. 7 is a set of curves showing the results of the experiment. Curve 702, obtained by subtracting the blank signal from the Ca solution signal, represents the net $^{40}Ca^+$ ion signal intensity (in counts per second, or cps) at m/z=40 from the 0.1 ppb calcium solution as a function of ion confinement duration (or storage time or reaction time, in ms) in the collision/reaction cell. Curve 704 represents the interfering background ion ($^{40}Ar^+$ ion) intensity from deionized water (DIW), or blank, as a function of ion confinement duration. Curve 706 represents the calculated background equivalent concentration or BEC (in parts-per-trillion, or ppt) as a function of ion confinement duration. BEC is inversely proportional to S/B ratio, as expressed by:

$$BEC=(\text{Background intensity}/\text{Signal intensity})*\text{Concentration of analyte}$$

The BEC curve 706 indicates that as the duration of ion confinement in the collision/reaction cell (and hence the reaction time) increases, the S/B ratio increases. FIG. 7 thus demonstrates the advantage provided by the collision/reaction cell and method for operating it disclosed herein.

Figure 8:
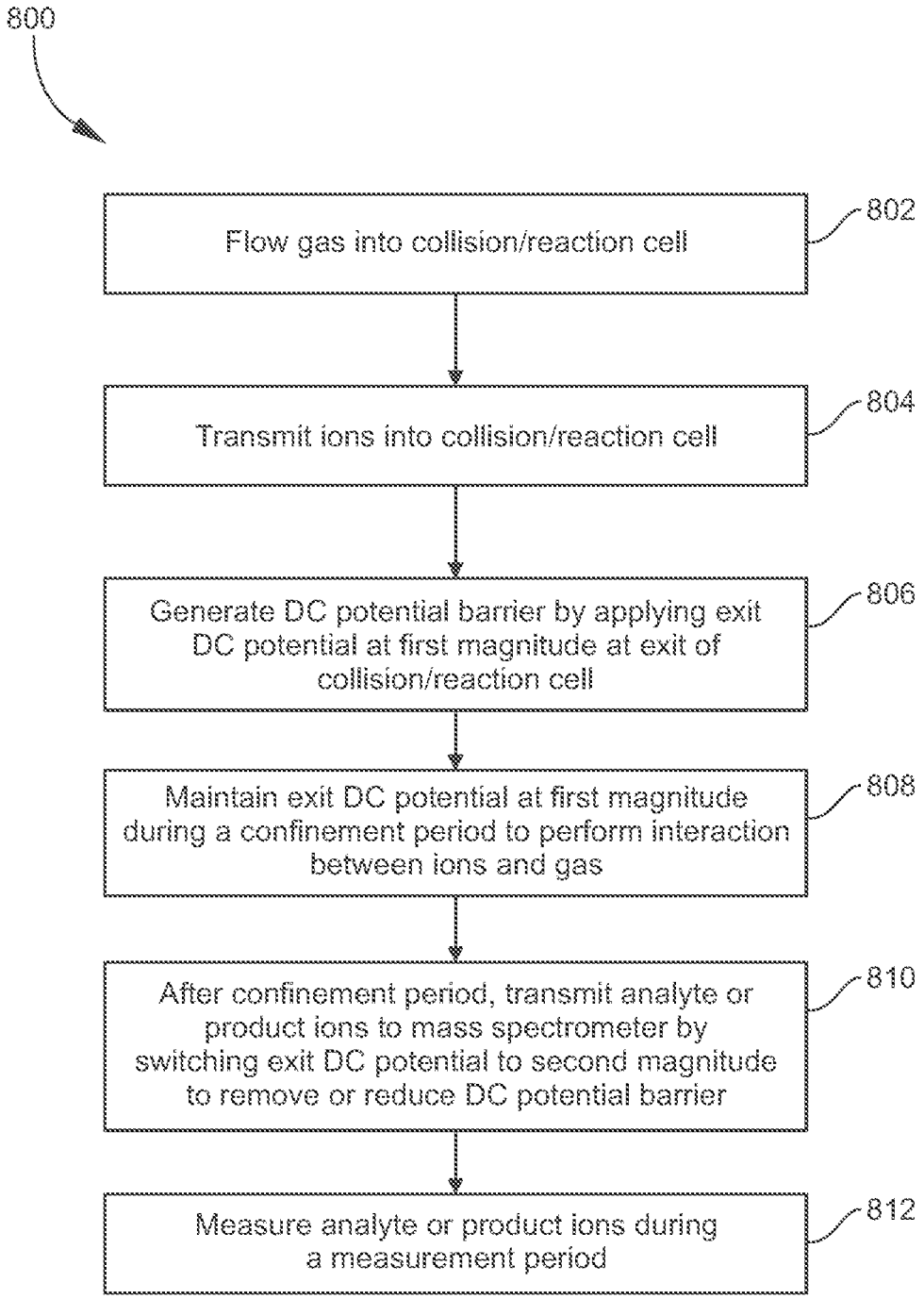
FIG. 8 is a flow diagram illustrating an example of a method for operating a collision/reaction cell in an inductively coupled plasma-mass spectrometry (ICP-MS) system according to an embodiment of the present disclosure.

FIG. 8 is a flow diagram 800 illustrating an example of a method for operating a collision/reaction cell in an inductively coupled plasma-mass spectrometry (ICP-MS) system according to an embodiment. A collision/reaction gas is flowed into the collision/reaction cell (step 802). The collision/reaction cell includes an entrance, an exit spaced from the entrance along a longitudinal axis of the collision/reaction cell, and a multipole ion guide positioned between the entrance and the exit. The multipole ion guide is configured to confine ions in a radial direction orthogonal to the longitudinal axis. Ions are transmitted through the entrance and into the collision/reaction cell (step 804). The ions transmitted are at least analyte ions produced from ionizing the sample that is under analysis. In some embodiments, interfering ions are also produced from a plasma-forming gas utilized in ionizing the sample and are also transmitted into the collision/reaction cell. An exit DC potential is applied at the exit at a first magnitude to generate a DC potential barrier effective to prevent the ions from exiting the collision/reaction cell (step 806). No specific limitation is placed on the order of the initiation of steps 802-806, and two or more of steps 802-806 may be initiated simultaneously or near simultaneously. The exit DC potential is maintained at the first magnitude during a confinement period to perform an interaction between the ions and the collision/reaction gas (step 808). The type of interaction depends on the mode of operation being implemented. The interaction may be effective to suppress interfering ion signal intensity as measured by a mass spectrometer. As examples, in one mode (a reaction mode for interfering ions, if any, and a collision mode for analyte ions), interfering ions, if any, are reacted with the collision/reaction gas according to a reaction effective to convert the interfering ions to non-interfering ions or to neutral species, and analyte ions are collided with the collision/reaction gas a plurality of times effective to slow down and confine the analyte ions in the collision/reaction cell. In another mode (a reaction mode for analyte ions, and a collision mode for product ions), analyte ions are reacted with the collision/reaction gas according to a reaction effective to produce product ions to be measured by a mass spectrometer, and the product ions are collided with the collision/reaction gas a plurality of times effective to slow down and confine the product ions in the collision/reaction cell. In this latter mode, the interfering ions are unreactive with the collision/reaction gas, and thus do not produce new ions in the collision/reaction cell that would interfere with the analyte-derived product ions. After the confinement period, the analyte ions or the product ions are transmitted to the mass spectrometer by switching the exit DC potential to a second magnitude that is effective to allow the analyte ions or the product ions to pass through the exit as a pulse having a pulse duration (step 810). The analyte ions or the product ions are then measured or counted for a measurement period (step 812). The measurement period may have a duration approximately equal to the pulse duration.

In an embodiment, the flow diagram 800 may represent a collision/reaction cell, or a collision/reaction cell and associated electronics, or a collision/reaction cell and associated ICP-MS system configured to carry out steps 802-812. For this purpose, a controller (e.g., the controller 120 shown in FIG. 1) including a processor, memory, and other components as appreciated by persons skilled in the art, may be provided to control the performance of steps 802-812, such as by controlling the components (e.g., the cell, electronics, etc.) of the ICP-MS system involved in carrying out steps 802-812.

Figure 9:
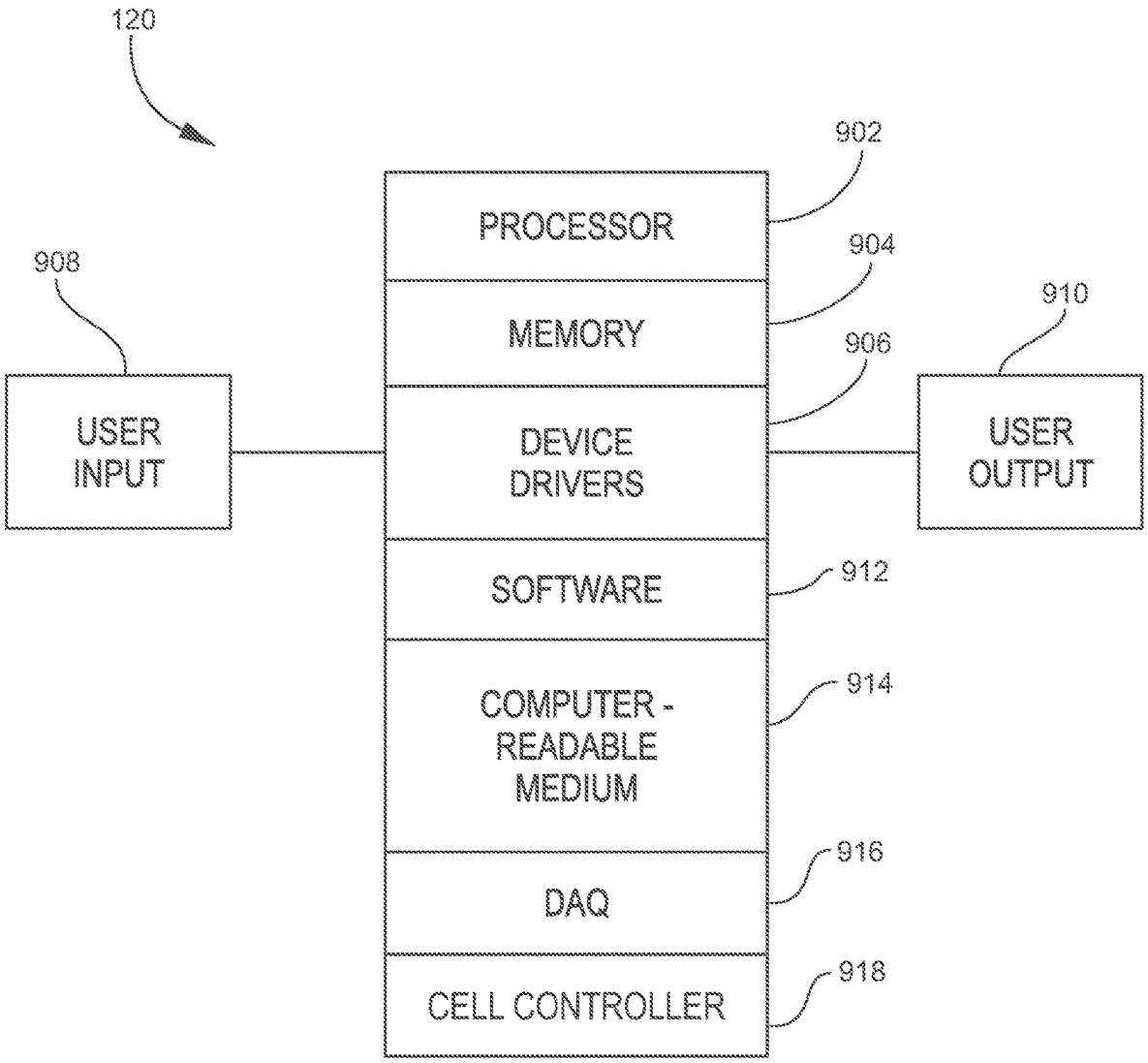
FIG. 9 is a schematic view of an example of a system controller (or controller, or computing device) that may be part of or communicate with a spectrometry system such as the ICP-MS system illustrated in FIG. 1.

FIG. 9 is a schematic view of a non-limiting example of the system controller (or controller, or computing device) 120 that may be part of or communicate with a spectrometry system such as the ICP-MS system 100 illustrated in FIG. 1. In the illustrated embodiment, the system controller 120 includes a processor 902 (typically electronics-based), which may be representative of a main electronic processor providing overall control, and one or more electronic processors configured for dedicated control operations or specific signal processing tasks (e.g., a graphics processing unit or GPU, a digital signal processor or DSP, an application-specific integrated circuit or ASIC, a field-programmable gate array or FPGA, etc.). The system controller 120 also includes one or more memories 904 (volatile and/or non-volatile) for storing data and/or software. The system controller 120 may also include one or more device drivers 906 for controlling one or more types of user interface devices and providing an interface between the user interface devices and components of the system controller 120 communicating with the user interface devices. Such user interface devices may include user input devices 908 (e.g., keyboard, keypad, touch screen, mouse, joystick, trackball, and the like) and user output devices 910 (e.g., display screen, printer, visual indicators or alerts, audible indicators or alerts, and the like). In various embodiments, the system controller 120 may be considered as including one or more of the user input devices 908 and/or user output devices 910, or at least as communicating with them. The system controller 120 may also include one or more types of computer programs or software 912 contained in memory and/or on one or more types of computer-readable media 914. The computer programs or software may contain non-transitory instructions (e.g., logic instructions) for controlling or performing various operations of the ICP-MS system 100. The computer programs or software may include application software and system software. System software may include an operating system (e.g., a Microsoft Windows® operating system) for controlling and managing various functions of the system controller 120, including interaction between hardware and application software. In particular, the operating system may provide a graphical user interface (GUI) displayable via a user output device 910, and with which a user may interact with the use of a user input device 908. The system controller 120 may also include one or more data acquisition/signal conditioning components (DAQs) 916 (as may be embodied in hardware, firmware and/or software) for receiving and processing ion measurement signals outputted by the ion detector 161 (FIG. 1), including formatting data for presentation in graphical form by the GUI.

The system controller 120 may further include a cell controller (or control module) 918 configured to control the operation of the collision/reaction cell 110 and coordinate and/or synchronize the cell operation with the operations of the ion source 108, the ion optics section 114, the mass analysis section 118, and any other ion processing devices provided in the ICP-MS system 100 illustrated in FIG. 1. Thus, the cell controller 918 may be configured to control or perform all or part of any of the methods disclosed herein, including methods for operating the collision/reaction cell 110. For these purposes, the cell controller 918 may be embodied in software and/or electronics (hardware and/or firmware) as appreciated by persons skilled in the art.

It will be understood that FIG. 9 is high-level schematic depiction of an example of a system controller 120 consistent with the present disclosure. Other components, such as additional structures, devices, electronics, and computer-related or electronic processor-related components may be included as needed for practical implementations. It will also be understood that the system controller 120 is schematically represented in FIG. 9 as functional blocks intended to represent structures (e.g., circuitries, mechanisms, hardware, firmware, software, etc.) that may be provided. The various functional blocks and any signal links between them have been arbitrarily located for purposes of illustration only and are not limiting in any manner Persons skilled in the art will appreciate that, in practice, the functions of the system controller 120 may be implemented in a variety of ways and not necessarily in the exact manner illustrated in FIG. 9 and described by example herein.

Various collision/reaction gases have been utilized to resolve spectral interferences in a quadrupole ICP-MS equipped with a collision/reaction cell. Such gases include He, $H_2$, $NH_3$, $CH_4$, $O_2$, $N_2O$, and mixtures of two gases such as $NH_3$ and He, or Ar and $H_2$. It has been a common and conventional practice to use high-purity industrial gas for such gases. See PerkinElmer, NexION 1000/2000 ICP-MS, PREPARING YOUR LAB (2018); Quarles, Jr. et al., Analytical method for total chromium and nickel in urine using an inductively coupled plasma-universal cell technology-mass spectrometer (ICP-UCT-MS) in kinetic energy discrimination (KED) mode, *J. Anal. At. Spectrom.*, Vol. 29, 297-303 (2014); Guo et al., Application of ion molecule reaction to eliminate WO interference on mercury determination in soil and sediment samples by ICP-MS, *J. Anal. At. Spectrom.*, Vol. 26, 1198-1203 (2011); and ThermoFisher Scientific, iCAP RQ ICP-MS Pre-Installation Requirements Guide, BRE0009927 Revision A, (November 2016); the contents of each of which are incorporated herein by reference in their entireties. High-purity industrial gases are usually provided from gas suppliers in the form of pressurized gas cylinders. For safety reasons, $H_2$ gas has also been available from a hydrogen generator or a canister containing a hydrogen-storing alloy. However, $H_2$ is an exception. For other collision/reaction gases including $O_2$ gas, high-pressure industrial gases have been utilized for reaction-cell ICP-MS.

As a reaction gas, $O_2$ has been useful for resolving the problem of certain spectral interferences in ICP-MS. Inside the reaction cell, a certain analyte ion $M^+$ reacts with an $O_2$ molecule to produce an oxide ion $MO^+$, as expressed by Equation (1) below. If an interfering ion $X^+$ that has the same m/z as $M^+$ does not produce $XO^+$ via reaction with $O_2$ (see Equation (2) below), it is possible to determine the element M by measuring $MO^+$, as $MO^+$ is now free from the $X^+$ interference.

$$M^+ + O_2 \rightarrow MO^+ + O \quad (1)$$

$$X^+ + O_2 \rightarrow \text{no reaction or no } XO^+ \text{ production} \quad (2)$$

Other industrial gases such as $N_2O$ and $CO_2$ have also been available to produce $MO^+$ in the collision/reaction cell, as expressed by Equations (3) and (4) below. See U.S. Pat. No. 6,875,618, the content of which is incorporated by reference herein in its entirety.

$$M^+ + N_2O \rightarrow MO^+ + N_2 \quad (3)$$

$$M^+ + CO_2 \rightarrow MO^+ + CO \quad (4)$$

Ambient air is capable of producing $MO^+$ as it contains $O_2$ gas. However, ambient air has not been utilized for this purpose in ICP-MS, despite being safe and cost-free. It is possible that ambient air has not been considered for use as a reaction gas due to concern that the multiple components constituting ambient air and/or the impurities (pollutants) in ambient air would have adverse effects on the performance of the reaction cell.

According to an aspect of the present disclosure, ambient air may be utilized effectively as a reaction gas in the reaction cell of an ICP-MS system, as a substitute or replacement for commercially obtained, pure $O_2$ gas (for example, from an industrial gas supplier) that is conventionally employed. In particular, the inventors have found that ambient air is particularly effective in an ICP-MS system having a triple quadrupole (QQQ) configuration.

Figure 10:
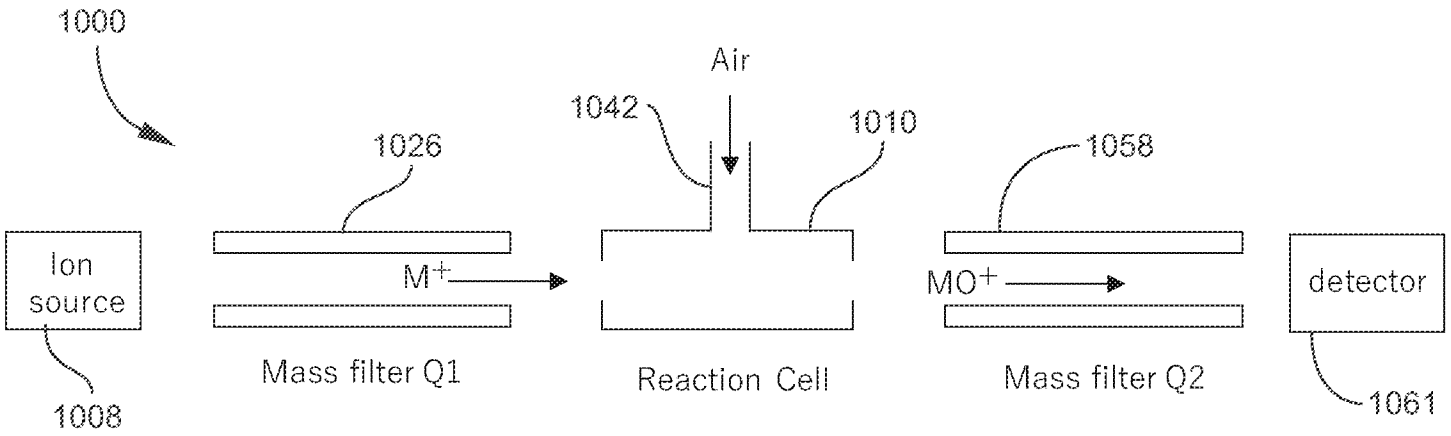
FIG. 10 is a schematic view of an example of an inductively coupled plasma-mass spectrometry (ICP-MS) system according to another embodiment of the present disclosure, in particular a system having a triple quadrupole (QQQ) configuration.

FIG. 10 is a schematic view of an example of an inductively coupled plasma-mass spectrometry (ICP-MS) system 1000 according to another embodiment of the present disclosure, in particular a system having a triple quadrupole (QQQ) configuration. As illustrated in FIG. 10 and as described earlier in this disclosure, such ICP-MS system 1000 includes, in order of ion process flow, an ICP ion source 1008, a first (or pre-cell) quadrupole mass filter (Q1) 1026, a reaction cell 1010 (or "collision/reaction cell" as defined herein), a second (final) quadrupole mass filter (Q2) 1058, and an ion detector 1061. A gas inlet 1042 (e.g., including a port, feed conduit, pump, etc.) is configured to flow ambient air into the interior of the reaction cell 1010. In some embodiments, the gas inlet 1042 may include a gas purifier configured to remove impurities or pollutants from the incoming ambient air. As nonexclusive examples, the gas purifier may include a purifying element (e.g., filter, trap, etc.) such as a molecular sieve (e.g., "molecular sieve 3 Å", which is a composite including silica and alumina and having a pore diameter of 3 Angstroms, or the like), a sorbent material such as activated charcoal, etc., or a combination of different types of purifying elements. The ICPMS system 1000 may have one or more other components as described above in conjunction with FIG. 1. The ICP-MS system 1000 with the triple-quad configuration may be operated as described earlier in this disclosure.

An instrument consistent with the ICP-MS system 1000 illustrated in FIG. 10 was operated to evaluate the effectiveness of ambient air as a reaction gas in comparison to commercially supplied, pure $O_2$ gas. Specifically, ambient air was introduced into the reaction cell 1010, and phosphorous (P) and sulfur (S) were measured as analytes. The element $^{31}P$ was measured as the product ion $^{31}P^{16}O^+$ with the first mass filter (Q1) 1026 set to m/z=31 and the second mass filter (Q2) 1058 set to m/z=47. Similarly, the element $^{32}S$ was measured as the product ion $^{32}S^{16}O^+$ with the first mass filter (Q1) 1026 set to m/z=32 and the second mass filter (Q2) 1058 set to m/z=48. The first mass filter (Q1) 1026 and the second mass filter (Q2) 1058 were both operated at a unit-mass resolution.

Typical interferences on $P^+$ (m/z=31) and $SO^+$ (m/z=32) are the polyatomic ions $^{14}N^{16}OH^+$ and $^{16}O_2^+$, respectively, which are produced in the ion source 1008 or immediately downstream of the ion source 1008. $O_2$ gas in the reaction cell 1010 removes these interferences when P and S are measured as $PO^+$ (m/z=47) and $SO^+$ (m/z=48), respectively, because $O_2$ gas reacts with $P^+$ and $S^+$ efficiently but not with $NOH^+$ and $O_2^+$, as expressed by Equations (5) to (8) below.

$$P^+ + O_2 \rightarrow PO^+ + O \quad (5)$$

$$NOH^+ + O_2 \rightarrow \text{no reaction or no } NOOH^+ \text{ production} \quad (6)$$

$$S^+ + O_2 \rightarrow SO^+ + O \quad (7)$$

$$O_2^+ + O_2 \rightarrow \text{no reaction or no } O_3^+ \text{ production} \quad (8)$$

Table 1 below shows data acquired for sensitivity (in counts per second/parts per billion (cps/ppb)) and background equivalent concentration (BEC (in ppb)) for P and S with the use of ambient air as the reaction gas. For comparison, Table 1 also shows the same data acquired for P and S with the use of high-purity (100% or near 100% pure) $O_2$ as the reaction gas.

TABLE 1

| | | P (Q1 mass: 31, Q2 mass: 47) | | S (Q1 mass: 32, Q2 mass: 48) | |
|---|---|---|---|---|---|
| Gas | Flow rate (sccm) | Sensitivity (cps/ppb) | BEC (ppb) | Sensitivity (cps/ppb) | BEC (ppb) |
| pure $O_2$ gas | 0.3 | 2746 | 0.12 | 4366 | 1.27 |
| ambient air | 0.4 | 2074 | 0.11 | 2161 | 1.06 |

The flow rates of the ambient air and the pure $O_2$ gas introduced into the reaction cell 1010 were adjusted so that the oxide ion signals (intensities of $PO^+$ and $SO^+$) were maximized. Even though the $O_2$ content in the ambient air is only 21%, the necessary flow rate of the ambient air (0.4 sccm) was almost equal to that of the pure $O_2$ gas (0.3 sccm). This was mainly due to the promotion of the reaction by $N_2$ and other inert gas molecules in the ambient air, as described further below.

The sensitivities for P and S with the use of ambient air, although lower than those with the use of pure $O_2$ gas, are sufficient for many analytical purposes. The BECs obtained with the ambient air are almost the same as or even slightly better (lower) than with the pure $O_2$ gas, indicating that the degree of interference reduction by the ambient air is comparable to the degree of interference reduction by the pure $O_2$ gas. Therefore, adverse effects of substances other than $O_2$ molecules in the ambient air on interference reduction is negligible for P and S determination.

An explanation for these results is as follows.

Dry air consists of (in approximate percentages) $N_2$ (78%), $O_2$ (21%), Ar (0.93%), $CO_2$ (0.04%), Ne (18 ppm), He (5 ppm), and other minor components at single-digit ppm levels or lower. Ambient air additionally contains water vapor ($H_2O$) in varying concentrations (0.001% to 5%) and possibly a variety of impurities having anthropogenic origins.

While 02 molecules in the air are available to produce $MO^+$ from $M^+$ in the reaction cell 1010, $N_2$, Ar, Ne, and He in the air are all inert gases, acting as a buffer gas in the reaction cell to promote the reaction between $O_2$ and $M^+$. Like $O_2$, $CO_2$ and water ($H_2O$) in the air are also reactive with certain $M^+$ ions to produce $MO^+$ ions, as expressed by Equation (4) above and (9) Equation below, respectively.

$$M^+ + H_2O \rightarrow MO^+ + H_2 \quad (9)$$

On the other hand, gaseous impurities in the ambient air, $B_j$ (j=1, 2, 3, . . . ), typically water vapor and various hydrocarbons, will react with ion species other than $M^+$, $A_i^+$ (i=1, 2, 3, . . . ), to produce a variety of reaction products, $C_{ij}^+$ and $D_{ij}$ (see Equation (10) below). If one of the product ion species $C_{ij}^+$ has the same m/z as $MO^+$, the interference-free detection of $MO^+$ is no longer possible.

$$A_i^+ + B_j \rightarrow C_{ij}^+ + D_{ij} \quad (10)$$

The ions produced from the impurities in the ambient air were also experimentally observed. The first mass filter (Q1) 1026 was set to m/z=40 to allow $^{40}Ar^+$ to enter the reaction cell 1010. The second mass filter (Q2) 1058 was scanned to measure the different ions produced from the reactions between $^{40}Ar^+$ and $B_j$ occurring in the reaction cell 1010 filled with the ambient air, as expressed by Equation (11) below.

$$^{40}Ar^+ + B_j \rightarrow C_j^+ + D_j \quad (11)$$

It should be noted that Equation (11) is a primary reaction and subsequent reactions may occur between $C_j^+$ and $B_j$ or between $^{40}Ar^+$ and $D_j$ that produce new ions other than $C_j^+$.

Figure 11:
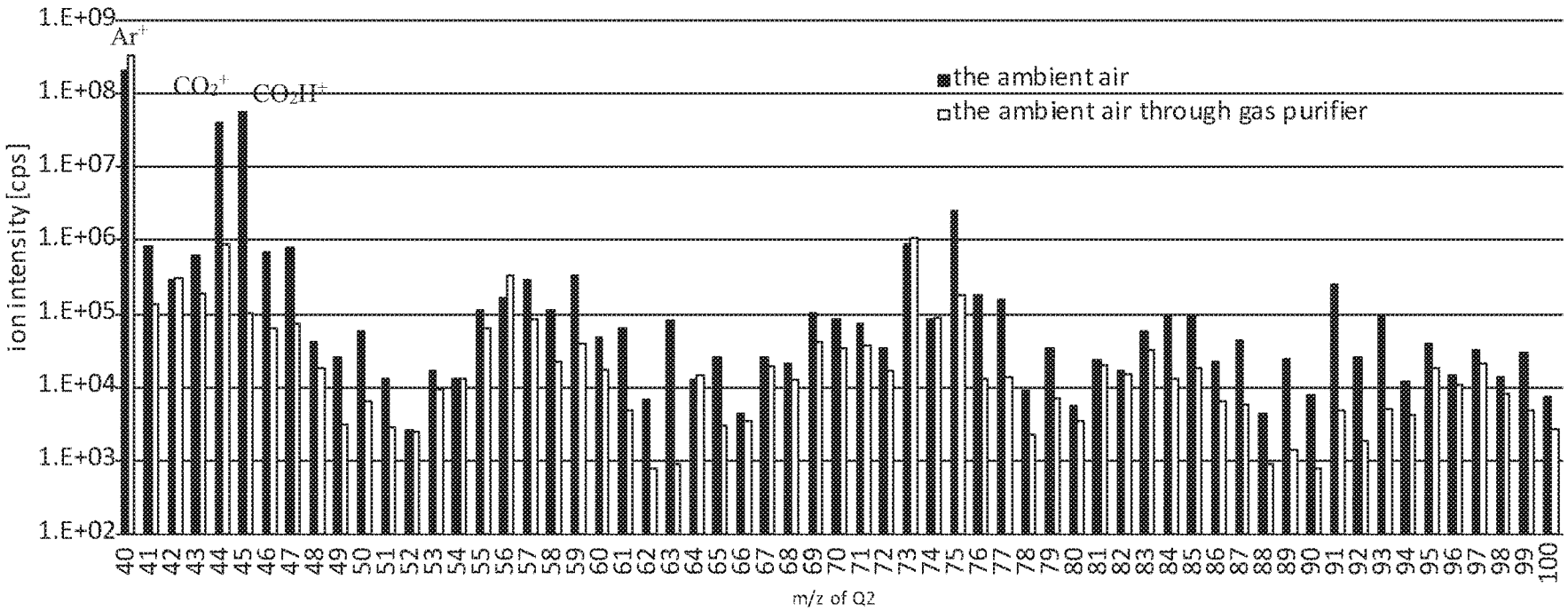
FIG. 11 is a plot of two spectra of the ion intensities (in cps) of product ions (m/z) produced from the reaction between $^{40}Ar^+$ and the components of unpurified ambient air and purified ambient air, respectively, when the unpurified or purified ambient air is introduced into a reaction cell of an ICP-MS system such as illustrated in FIG. 10.

FIG. 11 shows the results of the measurements, which represent $C_j^+$ and other ions produced from the reaction between $^{40}Ar^+$ and $B_j$ and its subsequent reactions. The measurements were carried out with the ambient air introduced to the reaction cell 1010 as is (in its natural state, without purification), and with the ambient air introduced via a gas purifier that included molecular sieve 3 Å and activated charcoal. Overall intensities of the product ions are lower when the gas purifier was utilized. The intensity of the reactive ion $^{40}Ar^+$ entering the reaction cell 1010 was constant when the two spectra (obtained from utilizing unpurified ambient air and purified ambient air, respectively) were measured. Therefore, the intensities of the product ions reflect the amount of $B_j$ introduced to the reaction cell 1010. The observed product ions originate from the reactions between one ion species $Ar^+$ and the constituents of the ambient air. If other ion species enter the reaction cell 1010, the product ions should be different in terms of intensity and kind.

In addition to P and S, other analytes may be processed in an ICP-MS system using ambient air as the reaction gas. Examples include, but are not limited to, titanium (Ti), arsenic (As), selenium (Se), and uranium (U).

The risk of impurities producing the interfering ions (the ions having the same m/z as $MO^+$) through the reactions with ions can be greatly reduced by operating the reaction cell 1010 in an ICP-MS system 1000 with the triple-quad configuration described herein and illustrated in FIG. 10. This is because the first mass filter (Q1) 1026 can be set (or tuned) to limit the ion species entering the reaction cell 1010 to only one m/z (the m/z of $M^+$), thereby suppressing the in-cell reactions that would otherwise occur between the gas components ($B_j$ in Equation (10)) and various ion species that were not ejected before the reaction cell 1010. For example, when phosphorus ($^{31}P$) was measured in the ICP-MS system 1000 with the triple-quad configuration, and with the first mass filter (Q1) 1026 set to m/z=31 and the second mass filter (Q2) 1058 set to m/z=47, the first mass filter (Q1) 1026 allowed only $^{31}P^+$ and the isobaric interfering ions such as $^{14}N^{16}OH^+$ to enter the reaction cell 1010. Therefore, $^{40}Ar^+$ ions, for example, were ejected from the ion beam by the first mass filter (Q1) 1026 before the reaction cell 1010, and thus never reacted to produce the m/z=47 ion shown in the spectra in FIG. 11. In a system without the first mass filter (Q1) 1026 (or in a single quadrupole configuration), $^{40}Ar^+$ and other ions from the ion source 1008 would enter the reaction cell 1010 (together with $P^+$) and react with impurity gases to produce a variety of reaction products, some of which could interfere with $MO^+$ due to having the same m/z as $MO^+$.

The humidity of ambient air changes due to changes in environmental conditions. As shown by Equation (9), the yield of the analyte ion $MO^+$ is affected by the concentration of $H_2O$ as well as $O_2$ in the reaction cell 1010. To ensure the stability of ion signals even if the weather or laboratory environment changes, purified ambient air may be introduced to the reaction cell 1010. The ambient air may be purified before flowing into the reaction cell 1010 by utilizing a gas purifier so that the ambient air entering reaction cell 1010 remains constant or homogeneous in composition regardless of environmental conditions. As described above, an optional (but preferable for some applications) gas purifier may be associated with the gas inlet 1042 in the schematic view of FIG. 10. As non-exclusive examples, the gas purifier may have a flow-through configuration that includes a molecular sieve (e.g., as a moisture trap) or a combination of a molecular sieve and activated charcoal (e.g., as a hydrocarbon trap). In general, this type of gas purifier can never filter out all components but $O_2$ to convert the ambient air to pure $O_2$ gas, i.e., can never completely isolate and allow only $O_2$ molecules to pass into the reaction cell 1010. Hence, for many applications, a triple-quad configuration will still be needed for the purified ambient air to function properly (or to function with a level of effectiveness deemed acceptable for analytical purposes in a given application).

In the context of the present disclosure, the term "ambient air" generally refers to atmospheric air having the composition noted above—namely, a mixture of primarily $N_2$ and $O_2$, and lesser concentrations of certain other gases, and also varying concentrations of water vapor. Ambient air is distinguished from synthetic air, which is produced by mixing high-purity nitrogen and high-purity oxygen and stored in a container to be used for various industrial purposes. Ambient air may also include certain contaminants or pollutants, some of which may be particulates rather than gas molecules. The ambient air taken into a collision/reaction cell may be unpurified or purified. Unpurified ambient air is ambient air that is not subjected to a purification (e.g., filtering, trapping, scrubbing, cleaning, etc.) process prior to being taken into a collision/reaction cell. Purified ambient air is ambient air that is subjected to some degree of purification prior to being taken into a collision/reaction cell so as to remove (or at least reduce the concentration of) one or more components (gases and/or particulates) of the ambient air other than $O_2$. The term "ambient air" may refer to air that can be taken into a collision/reaction cell from the local environment outside of the collision/reaction cell (or outside of the instrument or system of which the collision/reaction cell is a part) without first being stored or confined such as in the manner noted above (e.g., a container such as a gas cylinder, canister, or the like, typically obtained from an industrial gas supplier). That is, the source of the ambient air taken into a collision/reaction cell may be the local environment outside of the collision/reaction cell, and not a container filled with pure $O_2$ gas. The source of ambient air may be a room or space inside of a building (e.g., a laboratory) in which the collision/reaction cell operates. For purposes of the present disclosure, such an inside room or space is considered to be an example of a local environment outside of the collision/reaction cell, and is not considered to be air that is stored or confined. One exception to the foregoing definition is that in some embodiments, ambient air (having the multi-component composition described above) may be supplied to a collision/reaction cell from a pressurized container—that is, the source of the ambient air may be compressed air.

Figure 12:
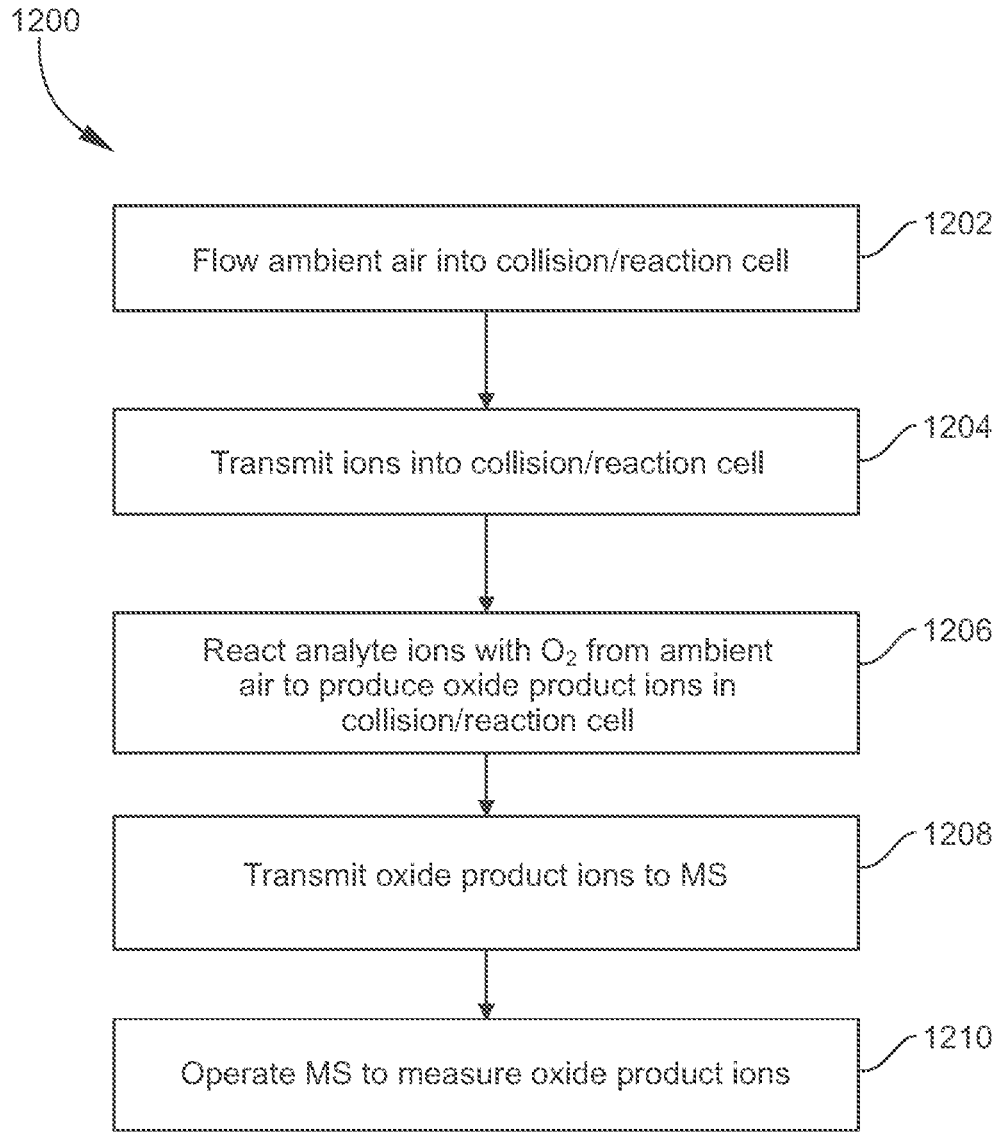
FIG. 12 is a flow diagram illustrating an example of a method for operating a collision/reaction cell in an inductively coupled plasma-mass spectrometry (ICP-MS) system according to another embodiment of the present disclosure.

FIG. 12 is a flow diagram 1200 illustrating an example of a method for operating a collision/reaction cell to suppress interferences in an inductively coupled plasma-mass spectrometry (ICP-MS) system according to another embodiment. Ambient air is flowed into the collision/reaction cell (step 1202). After initiating the flow of ambient air into the collision/reaction cell, ions are transmitted into the collision/reaction cell (step 1204). The ions transmitted are at least analyte ions ($M^+$) and may also include interfering ions ($X^+$). The analyte ions are reacted with oxygen molecules ($O_2$) of the ambient air to produce product ions in the collision/reaction cell (step 1206). The product ions are oxide ions ($MO^+$), i.e. oxides of the analyte ions (or oxidized analyte ions). The reacting is done in the presence of interfering ions ($X^+$) in the collision/reaction cell, which interfering ions have a mass-to-charge ratio equal to a mass-to-charge ratio of the analyte ions. The product ions are then transmitted to a mass spectrometer (step 1208). The mass spectrometer is operated to measure the product ions (step 1210).

As described above, the ambient air may be unpurified or purified prior to flowing the ambient air into the collision/reaction cell (step 1202). In the latter case, the method includes, before flowing the ambient air into the collision/reaction cell, purifying the ambient air to remove or reduce the concentration of one or more components of the ambient air other than the oxygen molecules.

In an embodiment, the transmitting of ions into the collision/reaction cell (step 1204) includes transmitting only the analyte ions and interfering ions (if any) having a mass-to-charge ratio equal to a mass-to-charge ratio of the analyte ions. Additionally, the operating of the mass spectrometer (step 1210) includes measuring only the product ions and other ions, if any, having a mass-to-charge ratio equal to a mass-to-charge ratio of the product ions.

For example, the method may include, before the transmitting of ions into the collision/reaction cell (step 1204), transmitting ions into a first mass filter set to allow only the analyte ions and interfering ions having a mass-to-charge ratio equal to a mass-to-charge ratio of the analyte ions to be transmitted into the collision/reaction cell. Additionally, the transmitting of the product ions to the mass spectrometer (step 1208) may include transmitting the product ions into a second mass filter of the mass spectrometer, and the operating of the mass spectrometer (step 1210) may include setting the second mass filter to allow only the product ions and other ions, if any, having a mass-to-charge ratio equal to a mass-to-charge ratio of the product ions to be transmitted to an ion detector of the mass spectrometer.

In further embodiments, one or more aspects of the method described above in conjunction with FIGS. 1-9 may be applied when utilizing ambient air as the reaction gas.

In an embodiment, the flow diagram 1200 may represent a collision/reaction cell, or a collision/reaction cell and associated electronics, or a collision/reaction cell and associated ICP-MS system, configured to carry out steps 1202-1210. For this purpose, a controller (e.g., the controller 120 shown in FIG. 1) including a processor, memory, and other components as appreciated by persons skilled in the art, may be provided to control the performance of steps 1202-1210, such as by controlling the components (e.g., the cell, electronics, etc.) of the ICP-MS system involved in carrying out steps 1202-1210.

EXEMPLARY EMBODIMENTS

Exemplary embodiments provided in accordance with the presently disclosed subject matter include, but are not limited to, the following:

1. A method for operating a collision/reaction cell in an inductively coupled plasma-mass spectrometry (ICP-MS) system, the method comprising: flowing a collision/reaction gas into the collision/reaction cell, the collision/reaction cell comprising an entrance, an exit spaced from the entrance along a longitudinal axis of the collision/reaction cell, and a multipole ion guide positioned between the entrance and the exit and configured to confine ions in a radial direction orthogonal to the longitudinal axis; transmitting ions through the entrance and into the collision/reaction cell; applying an exit DC potential at the exit at a first magnitude to generate a DC potential barrier effective to prevent the ions from exiting the collision/reaction cell; maintaining the exit DC potential at the first magnitude during a confinement period; during the confinement period, colliding the ions with the collision/reaction gas, wherein the ions undergo collisions a plurality of times effective to slow down and confine the ions in the collision/reaction cell; after the confinement period, transmitting at least analyte ions of the confined ions to a mass spectrometer, by switching the exit DC potential to a second magnitude effective to allow the analyte ions to pass through the exit as a pulse having a pulse duration; and counting the analyte ions for a measurement period having a duration approximately equal to the pulse duration.

2. A method for operating a collision/reaction cell to suppress interferences in an inductively coupled plasma-mass spectrometry (ICP-MS) system, the method comprising: flowing a collision/reaction gas into the collision/reaction cell, the collision/reaction cell comprising an entrance, an exit spaced from the entrance along a longitudinal axis of the collision/reaction cell, and a multipole ion guide positioned between the entrance and the exit and configured to confine ions in a radial direction orthogonal to the longitudinal axis; transmitting ions through the entrance and into the collision/reaction cell, wherein the ions comprise analyte ions and interfering ions produced from ionizing a sample under analysis utilizing a plasma-forming gas; applying an exit DC potential at the exit at a first magnitude to generate a DC potential barrier effective to prevent the ions from exiting the collision/reaction cell; maintaining the exit DC potential at the first magnitude during a confinement period to perform an interaction effective to suppress interfering ion signal intensity as measured by a mass spectrometer, the interaction selected from the group consisting of: reacting the interfering ions with the collision/reaction gas according to a reaction effective to convert the interfering ions to non-interfering ions or to neutral species, wherein the analyte ions collide with the collision/reaction gas a plurality of times effective to slow down and confine the analyte ions in the collision/reaction cell; and reacting the analyte ions with the collision/reaction gas according to a reaction effective to produce product ions, wherein the product ions collide with the collision/reaction gas a plurality of times effective to slow down and confine the product ions in the collision/reaction cell; after the confinement period, transmitting the analyte ions or the product ions to the mass spectrometer by switching the exit DC potential to a second magnitude effective to allow the analyte ions or the product ions to pass through the exit as a pulse having a pulse duration; and counting the analyte ions or the product ions for a measurement period having a duration approximately equal to the pulse duration.

3. The method of embodiment 1 or 2, wherein the first magnitude and the second magnitude are selected from the group consisting of: the second magnitude is more negative than the first magnitude; the first magnitude is a positive or zero magnitude and the second magnitude is a negative or zero magnitude; the first magnitude is in a range from 0 V to +100 V; the second magnitude is in a range from −200 V to 0 V; and a combination of two or more of the foregoing.

4. The method of any of the preceding embodiments, wherein the switching has a duration in a range from 0.01 ms to 0.1 ms.

5. The method of any of the preceding embodiments, wherein the confinement period has a duration in a range from 0 ms to 1000 ms.

6. The method of any of the preceding embodiments, wherein the measurement period has a duration in a range from a FWHM of a peak of the pulse to five times the FWHM.

7. The method of any of the preceding embodiments, wherein the pulse duration is in a range from 0.01 ms to 1 ms.

8. The method of any of the preceding embodiments, wherein applying the exit DC potential at the exit comprises applying the exit DC potential at an exit lens of the collision/reaction cell.

9. The method of any of the preceding embodiments, comprising applying an axial DC potential gradient along the multipole ion guide, wherein the confined ions are prevented from exiting the collision/reaction cell through the entrance during the confinement period.

10. The method of any of the preceding embodiments, comprising continuing to transmit the ions through the entrance and into the collision/reaction cell during the confinement period.

11. The method of any of embodiments 1-9, comprising applying an entrance DC potential at the entrance during at least a latter part of the confinement period effective to prevent the confined analyte ions from exiting the collision/reaction cell through the entrance and prevent interfering ions from entering the collision/reaction cell through the entrance.

12. The method of any of the preceding embodiments, comprising applying an entrance DC potential at the entrance during the measurement period effective to prevent interfering ions from entering the collision/reaction cell through the entrance.

13. The method of any of the preceding embodiments, comprising, before transmitting the ions through the entrance and into the collision/reaction cell, producing the ions by exposing the sample to an inductively coupled plasma.

14. The method of embodiment 13, wherein exposing the sample comprises operating a plasma torch.

15. The method of embodiment 13 or 14, comprising flowing the sample into the plasma torch from a nebulizer or a spray chamber.

16. The method of any of the preceding embodiments, comprising selecting the collision/reaction gas based on the chemical identity of the analyte ion and the chemical identity of the interfering ions.

17. The method of any of the preceding embodiments, wherein the analyte ions are first analyte ions of a first mass, the interfering ions are first interfering ions, the confinement period is a first confinement period of a first duration, the pulse is a first pulse, and the analyte ions further comprise second analyte ions of a second mass different from the first mass, and further comprising: after measuring the first analyte ions contained in the first pulse, again applying the exit DC potential at the exit at the first magnitude for a second confinement period of a second duration different from the first duration; during the second confinement period, reacting the collision/reaction gas with second interfering ions that interfere with the second analyte ions, or reacting the collision/reaction gas with the second analyte ions, to suppress interference; after the second confinement period, transmitting a second pulse to the mass spectrometer by switching the exit DC potential to the second magnitude; and measuring the second analyte ions or product ions formed from the second analyte ions that are contained in the second pulse.

18. The method of any of the preceding embodiments, wherein the analyte ions are first analyte ions of a first mass, the interfering ions are first interfering ions, the confinement period is a first confinement period of a first duration, and the pulse is a first pulse, and further comprising: after counting the first analyte ions, transmitting second analyte ions of a second mass different from the first mass, and transmitting second interfering ions that interfere with the second analyte ions, through the entrance and into the collision/reaction cell; during a second confinement period of a second duration different from the first duration, applying the exit DC potential at the exit at the first magnitude to prevent the second analyte ions and the second interfering ions from exiting the collision/reaction cell during the second confinement period; during the second confinement period, reacting the collision/reaction gas with the second interfering ions or the second analyte ions to suppress interfering ion signal intensity; and after the second confinement period, transmitting the second analyte ions, or product ions formed from the second analyte ions, to the mass spectrometer by switching the exit DC potential to the second magnitude to pass through the exit as a second pulse.

19. The method of embodiment 17 or 18, comprising selecting the first duration based on the chemical identity of the first analyte ion and the first interfering ion; and the second duration based on the chemical identity of the second analyte ion and the second interfering ion.

20. The method of any of embodiments 17-19, comprising flowing the collision/reaction gas into the collision/reaction cell during the first confinement period at a flow rate, and flowing the collision/reaction gas into the collision/reaction cell during the second confinement period at the same flow rate.

21. The method of any of the preceding embodiments, wherein the collision/reaction gas is selected from the group consisting of: helium; neon; argon; hydrogen; oxygen; water; air; ammonia; methane; fluoromethane; nitrous oxide; and a combination of two or more of the foregoing.

22. The method of any of the preceding embodiments, wherein the analyte ions are selected from the group consisting of: positive monatomic ions of a metal or other element except for a rare gas; and product ions produced by reacting the collision/reaction gas with positive monatomic ions of a metal or other element except for a rare gas.

23. The method of any of the preceding embodiments, wherein the interfering ions are selected from the group consisting of: positive argon ions; polyatomic ions containing argon; doubly-charged ions containing a component of the sample; isobaric ions containing a component of the sample; and polyatomic ions containing a component of the sample.

24. A method for analyzing a sample, the method comprising: producing analyte ions from the sample; transmitting the analyte ions into the collision/reaction cell of any of the preceding embodiments; operating the collision/reaction cell according to the method of any of the preceding embodiments; and transmitting the analyte ions or the product ions into a mass analyzer of the mass spectrometer.

25. An inductively coupled plasma-mass spectrometry (ICP-MS) system, comprising: an ion source configured to generate plasma and produce analyte ions in the plasma; the collision/reaction cell of any of the preceding embodiments; and a controller comprising an electronic processor and a memory, and configured to control the steps of the method of any of the preceding embodiments.

26. An inductively coupled plasma-mass spectrometry (ICP-MS) system, comprising: an ion source configured to generate plasma and produce analyte ions in the plasma; a collision/reaction cell comprising an entrance configured to receive the analyte ions from the ion source, an exit spaced from the entrance along a longitudinal axis of the collision/reaction cell, and a multipole ion guide positioned between the entrance and the exit and configured to confine ions in a radial direction orthogonal to the longitudinal axis; a mass spectrometer communicating with the exit; and a controller comprising an electronic processor and a memory, and configured to control an operation comprising: flowing a collision/reaction gas into the collision/reaction cell; transmitting ions through the entrance and into the collision/reaction cell, wherein the ions comprise analyte ions and interfering ions produced in the ion source; applying an exit DC potential at the exit at a first magnitude to generate a DC potential barrier effective to prevent the ions from exiting the collision/reaction cell; maintaining the exit DC potential at the first magnitude during a confinement period to perform an interaction effective to suppress interfering ion signal intensity as measured by the mass spectrometer, the interaction selected from the group consisting of: reacting the interfering ions, if any, with the collision/reaction gas according to a reaction effective to convert the interfering ions to non-interfering ions or to neutral species, wherein the analyte ions collide with the collision/reaction gas a plurality of times effective to slow down and confine the analyte ions in the collision/reaction cell; and reacting the analyte ions with the collision/reaction gas according to a reaction effective to produce product ions to be measured by the mass spectrometer, wherein the product ions collide with the collision/reaction gas a plurality of times effective to slow down and confine the product ions in the collision/reaction cell; after the confinement period, transmitting the analyte ions or the product ions to the mass spectrometer by switching the exit DC potential to a second magnitude effective to allow the analyte ions or the product ions to pass through the exit as a pulse having a pulse duration; and measuring the analyte ions or the product ions for a measurement period having a duration approximately equal to the pulse duration.

27. The ICP-MS system of embodiment 25 or 26, wherein the controller is configured to control applying an axial DC potential gradient along the multipole ion guide, wherein the confined ions are prevented from exiting the collision/reaction cell through the entrance during the confinement period.

28. The ICP-MS system of any of embodiments 25-27, comprising an exit lens, wherein the controller is configured to apply the exit DC potential at the exit lens.

29. The ICP-MS system of any of embodiments 25-28, wherein the ion source comprises a plasma torch.

30. The ICP-MS system of any of embodiments 25-29, comprising a collision/reaction gas source configured to flow the collision/reaction gas into the collision/reaction cell.

31. The method or system of any of the preceding embodiments, wherein the mass spectrometer is a non-pulsed instrument.

32. The method or system of embodiment 31, wherein the non-pulsed instrument comprises a multipole device or a sector instrument configured for non-pulsed operation.

33. A method for operating a collision/reaction cell to suppress interferences in an inductively coupled plasma-mass spectrometry (ICP-MS) system, the method comprising: flowing ambient air into the collision/reaction cell; transmitting ions into the collision/reaction cell, wherein the ions comprise analyte ions ($M^+$); reacting the analyte ions with oxygen molecules ($O_2$) of the ambient air to produce product ions, wherein the product ions are oxide ions ($MO^+$), the reacting is done in the presence of interfering ions ($X^+$) in the collision/reaction cell, and the interfering ions have a mass-to-charge ratio equal to a mass-to-charge ratio of the analyte ions; transmitting the product ions to a mass spectrometer; and operating the mass spectrometer to measure the product ions.

34. The method of embodiment 33, wherein the ambient air is unpurified prior to flowing the ambient air into the collision/reaction cell.

35. The method of embodiment 33, comprising, before flowing the ambient air into the collision/reaction cell, purifying the ambient air to remove or reduce the concentration of one or more components of the ambient air other than the oxygen molecules.

36. The method of any of embodiments 33-35, wherein: the transmitting of ions into the collision/reaction cell comprises transmitting only the analyte ions and interfering ions having a mass-to-charge ratio equal to a mass-to-charge ratio of the analyte ions; and the operating of the mass spectrometer comprises measuring only the product ions and other ions, if any, having a mass-to-charge ratio equal to a mass-to-charge ratio of the product ions.

37. The method of any of embodiments 33-36, comprising, before the transmitting of ions into the collision/reaction cell, transmitting ions into a first mass filter set to allow only the analyte ions and interfering ions having a mass-to-charge ratio equal to a mass-to-charge ratio of the analyte ions to be transmitted into the collision/reaction cell, wherein: the transmitting of the product ions to the mass spectrometer comprises transmitting the product ions into a second mass filter of the mass spectrometer; and the operating of the mass spectrometer comprises setting the second mass filter to allow only the product ions and other ions, if any, having a mass-to-charge ratio equal to a mass-to-charge ratio of the product ions to be transmitted to an ion detector of the mass spectrometer.

38. The method of any of embodiments 33-37, wherein the collision/reaction cell comprises an entrance into which the ions comprising analyte ions are transmitted, an exit from which the product ions are transmitted to the mass spectrometer, and a multipole ion guide positioned between the entrance and the exit.

39. The method of embodiment 38, comprising: applying an exit DC potential at the exit at a first magnitude to generate a DC potential barrier effective to prevent the ions from exiting the collision/reaction cell; and maintaining the exit DC potential at the first magnitude during a confinement period, wherein: the reacting of the analyte ions with oxygen molecules is done during the confinement period; and the transmitting of the product ions to the mass spectrometer is done after the confinement period, and comprises switching the exit DC potential to a second magnitude effective to allow the product ions to pass through the exit as a pulse having a pulse duration.

40. The method of embodiment 39, wherein the operating of the mass spectrometer comprises measuring the product ions for a measurement period having a duration approximately equal to the pulse duration.

41. The method of any of embodiments 33-40, comprising one or more of the features or steps of any of embodiments 3-20, 22, and/or 23.

42. A method for analyzing a sample, the method comprising: producing analyte ions from the sample; transmitting the analyte ions into the collision/reaction cell of any of embodiments 33-41; operating the collision/reaction cell according to the method of any of embodiments 33-41; and transmitting the product ions into a mass analyzer of the mass spectrometer.

43. An inductively coupled plasma-mass spectrometry (ICP-MS) system, comprising: an ion source configured to generate plasma and produce analyte ions in the plasma; the collision/reaction cell of any of embodiments 33-41; and a controller comprising an electronic processor and a memory, and configured to control the steps of the method of any of embodiments 33-42.

It will be understood that one or more of the processes, sub-processes, and process steps described herein may be performed by hardware, firmware, software, or a combination of two or more of the foregoing, on one or more electronic or digitally-controlled devices. The software may reside in a software memory (not shown) in a suitable electronic processing component or system such as, for example, the computing device 120 schematically depicted in FIG. 1. The software memory may include an ordered listing of executable instructions for implementing logical functions (that is, "logic" that may be implemented in digital form such as digital circuitry or source code, or in analog form such as an analog source such as an analog electrical, sound, or video signal). The instructions may be executed within a processing module, which includes, for example, one or more microprocessors, general purpose processors, combinations of processors, digital signal processors (DSPs), field-programmable gate arrays (FPGAs), or application specific integrated circuits (ASICs). Further, the schematic diagrams describe a logical division of functions having physical (hardware and/or software) implementations that are not limited by architecture or the physical layout of the functions. The examples of systems described herein may be implemented in a variety of configurations and operate as hardware/software components in a single hardware/software unit, or in separate hardware/software units.

The executable instructions may be implemented as a computer program product having instructions stored therein which, when executed by a processing module of an electronic system (e.g., the computing device 120 in FIG. 1), direct the electronic system to carry out the instructions. The computer program product may be selectively embodied in any non-transitory computer-readable storage medium for use by or in connection with an instruction execution system, apparatus, or device, such as an electronic computer-based system, processor-containing system, or other system that may selectively fetch the instructions from the instruction execution system, apparatus, or device and execute the instructions. In the context of this disclosure, a computer-readable storage medium is any non-transitory means that may store the program for use by or in connection with the instruction execution system, apparatus, or device. The non-transitory computer-readable storage medium may selectively be, for example, an electronic, magnetic, optical, electromagnetic, infrared, or semiconductor system, apparatus, or device. A non-exhaustive list of more specific examples of non-transitory computer readable media include: an electrical connection having one or more wires (electronic); a portable computer diskette (magnetic); a random access memory (electronic); a read-only memory (electronic); an erasable programmable read only memory such as, for example, flash memory (electronic); a compact disc memory such as, for example, CD-ROM, CD-R, CD-RW (optical); and digital versatile disc memory, i.e., DVD (optical). Note that the non-transitory computer-readable storage medium may even be paper or another suitable medium upon which the program is printed, as the program may be electronically captured via, for instance, optical scanning of the paper or other medium, then compiled, interpreted, or otherwise processed in a suitable manner if necessary, and then stored in a computer memory or machine memory.

It will also be understood that the term "in signal communication" as used herein means that two or more systems, devices, components, modules, or sub-modules are capable of communicating with each other via signals that travel over some type of signal path. The signals may be communication, power, data, or energy signals, which may communicate information, power, or energy from a first system, device, component, module, or sub-module to a second system, device, component, module, or sub-module along a signal path between the first and second system, device, component, module, or sub-module. The signal paths may include physical, electrical, magnetic, electromagnetic, electrochemical, optical, wired, or wireless connections. The signal paths may also include additional systems, devices, components, modules, or sub-modules between the first and second system, device, component, module, or sub-module.

More generally, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A method for operating a collision/reaction cell to suppress interferences in an inductively coupled plasma-mass spectrometry (ICP-MS) system, the method comprising:

flowing ambient air into the collision/reaction cell via a gas inlet, wherein the flowing is done according to one of:

the ambient air is unpurified before the flowing;

before the flowing, purifying the ambient air by passing the ambient air through an air purifier disposed at the gas inlet;

transmitting ions into the collision/reaction cell, wherein the ions comprise analyte ions;

reacting the analyte ions with oxygen molecules of the ambient air to produce product ions, wherein the product ions are oxide ions, the reacting is done in the presence of interfering ions in the collision/reaction cell, and the interfering ions have a mass-to-charge ratio equal to a mass-to-charge ratio of the analyte ions;

transmitting the product ions to a mass spectrometer; and operating the mass spectrometer to measure the product ions.

2. The method of claim 1, wherein:

the transmitting of ions into the collision/reaction cell comprises transmitting only the analyte ions and interfering ions having a mass-to-charge ratio equal to a mass-to-charge ratio of the analyte ions; and the operating of the mass spectrometer comprises measuring only the product ions and other ions, if any, having a mass-to-charge ratio equal to a mass-to-charge ratio of the product ions.

3. The method of claim 1, comprising, before the transmitting of ions into the collision/reaction cell, transmitting ions into a first quadrupole mass filter set to allow only the analyte ions and interfering ions having a mass-to-charge ratio equal to a mass-to-charge ratio of the analyte ions to be transmitted into the collision/reaction cell, wherein:

the transmitting of the product ions to the mass spectrometer comprises transmitting the product ions into a second quadrupole mass filter of the mass spectrometer; and the operating of the mass spectrometer comprises setting the second quadrupole mass filter to allow only the product ions and other ions, if any, having a mass-to-charge ratio equal to a mass-to-charge ratio of the product ions to be transmitted to an ion detector of the mass spectrometer.

4. The method of claim 1, wherein the collision/reaction cell comprises an entrance into which the ions comprising analyte ions are transmitted, an exit from which the product ions are transmitted to the mass spectrometer, and a multipole ion guide positioned between the entrance and the exit.

5. The method of claim 4, comprising:

applying an exit DC potential at the exit at a first magnitude to generate a DC potential barrier effective to prevent the ions from exiting the collision/reaction cell; and maintaining the exit DC potential at the first magnitude during a confinement period, wherein:

the reacting of the analyte ions with oxygen molecules is done during the confinement period; and the transmitting of the product ions to the mass spectrometer is done after the confinement period, and comprises switching the exit DC potential to a second magnitude effective to allow the product ions to pass through the exit as a pulse having a pulse duration.

6. The method of claim 5, wherein the operating of the mass spectrometer comprises measuring the product ions for a measurement period having a duration approximately equal to the pulse duration.

7. The method of claim 5, wherein the first magnitude and the second magnitude are selected from the group consisting of:

the second magnitude is more negative than the first magnitude;

the first magnitude is a positive or zero magnitude and the second magnitude is a negative or zero magnitude;

the first magnitude is in a range from 0 V to +100 V; and the second magnitude is in a range from −200 V to 0 V.

8. The method of claim 5, wherein the switching has a duration in a range from 0.01 ms to 0.1 ms.

9. The method of claim 8, The method of claim 5, wherein the confinement period has a duration in a range from 0 ms to 1000 ms.

10. The method of claim 5, wherein the measurement period has a duration in a range from a full width half maximum (FWHM) of a peak of the pulse to five times the FWHM.

11. The method of claim 5, wherein the pulse duration is in a range from 0.01 ms to 1 ms.

12. The method of claim 5, wherein applying the exit DC potential at the exit comprises applying the exit DC potential at an exit lens of the collision/reaction cell.

13. The method of claim 5, comprising performing a step selected from the group consisting of:

applying an entrance DC potential at the entrance during at least a latter part of the confinement period effective to prevent the confined analyte ions from exiting the collision/reaction cell through the entrance and prevent interfering ions from entering the collision/reaction cell through the entrance;

applying an entrance DC potential at the entrance during the measurement period effective to prevent interfering ions from entering the collision/reaction cell through the entrance; and both of the foregoing.

14. The method of claim 4, comprising applying an axial DC potential gradient along the multipole ion guide, wherein the confined ions are prevented from exiting the collision/reaction cell through the entrance during the confinement period.

15. The method of claim 1, comprising, before transmitting the ions into the collision/reaction cell, performing a step selected from the group consisting of:

producing the ions by exposing the sample to an inductively coupled plasma;

producing the ions by exposing the sample to an inductively coupled plasma, wherein exposing the sample comprises operating a plasma torch; and flowing the sample into a plasma torch from a nebulizer or a spray chamber, and producing the ions by exposing the sample to an inductively coupled plasma produced by the plasma torch.

16. A method for analyzing a sample, the method comprising:

producing analyte ions from the sample; and operating a collision/reaction cell according to the method of claim 1, wherein:

the analyte ions produced from the sample are transmitted into the collision/reaction cell; and the transmitting the product ions to the mass spectrometer comprises transmitting the product ions into a mass analyzer of the mass spectrometer.

17. An inductively coupled plasma-mass spectrometry (ICP-MS) system, comprising:

an ion source configured to generate plasma and produce analyte ions in the plasma;

a collision/reaction cell comprising a gas inlet;

a mass spectrometer; and a controller comprising an electronic processor and a memory, and configured to control an operation comprising:

flowing ambient air into the collision/reaction cell via the gas inlet, wherein the flowing is done according to one of:

the ambient air is unpurified before the flowing;

before the flowing, purifying the ambient air by passing the ambient air through an air purifier disposed at the gas inlet;

transmitting ions into the collision/reaction cell, wherein the ions comprise analyte ions;

reacting the analyte ions with oxygen molecules of the ambient air to produce product ions, wherein the product ions are oxide ions, the reacting is done in the presence of interfering ions in the collision/reaction cell, and the interfering ions have a mass-to-charge ratio equal to a mass-to-charge ratio of the analyte ions;

transmitting the product ions to the mass spectrometer; and operating the mass spectrometer to measure the product ions.

18. The ICP-MS system of claim 17, comprising a first quadrupole mass filter disposed between the ion source and the collision/reaction cell, wherein the ions transmitted into the collision/reaction cell are transmitted from the first mass filter, and the mass spectrometer comprises a second quadrupole mass filter to which the product ions are transmitted from the collision/reaction cell.

* * * * *